US008576257B2

(12) United States Patent
Kiya et al.

(10) Patent No.: US 8,576,257 B2
(45) Date of Patent: Nov. 5, 2013

(54) INTEGRATED CIRCUIT DEVICE, ELECTRO-OPTICAL DEVICE, AND ELECTRONIC INSTRUMENT

(75) Inventors: Hiroshi Kiya, Suwa (JP); Chihiro Shin, Chino (JP); Haruo Kamijo, Shiojiri (JP); Motoaki Nishimura, Fujimi-machi (JP); Katsuhiko Maki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1355 days.

(21) Appl. No.: 12/339,742

(22) Filed: Dec. 19, 2008

(65) Prior Publication Data

US 2009/0160882 A1 Jun. 25, 2009

(30) Foreign Application Priority Data

Dec. 20, 2007 (JP) ..... 2007-328572

(51) Int. Cl.
*G09G 5/10* (2006.01)

(52) U.S. Cl.
USPC ..... 345/690; 345/691; 345/692

(58) Field of Classification Search
USPC ..... 345/87–103, 204, 205, 211, 213, 345/690–692; 716/21, 54; 257/72, 501, 257/679; 340/572.8; 330/252
See application file for complete search history.

(56) References Cited

U.S. PATENT DOCUMENTS 5,414,443 A * 5/1995 Kanatani et al. ..... 345/95
5,617,113 A * 4/1997 Prince ..... 345/103
6,064,585 A * 5/2000 Mori et al. ..... 365/63
6,243,082 B1 * 6/2001 Konishi ..... 345/204
6,552,705 B1 * 4/2003 Hirota ..... 345/92
6,570,103 B1 * 5/2003 Saka et al. ..... 178/18.01
6,747,626 B2 * 6/2004 Chiang ..... 345/98
2002/0080104 A1 * 6/2002 Aoki ..... 345/87
2002/0113783 A1 * 8/2002 Tamura et al. ..... 345/213
2003/0156086 A1 * 8/2003 Maeda et al. ..... 345/89
2003/0164843 A1 9/2003 Sakaguchi
2003/0231153 A1 12/2003 Seong et al.
2004/0056252 A1 * 3/2004 Kasai ..... 257/72
2004/0125093 A1 * 7/2004 Rutman et al. ..... 345/204
2004/0164943 A1 * 8/2004 Ogawa et al. ..... 345/92

(Continued)

FOREIGN PATENT DOCUMENTS

JP A-2003-216125 7/2003
JP A-2004-029795 1/2004
JP A-2005-107239 4/2005
JP A-2005-175811 6/2005
JP A-2005-175812 6/2005
JP A-2007-183573 7/2007
JP A-2007-243125 9/2007

OTHER PUBLICATIONS

U.S. Appl. No. 12/339,498, filed Dec. 19, 2008 in the name of Hiroshi Kiya et al.

(Continued)

*Primary Examiner* — Prabodh M Dharia
(74) *Attorney, Agent, or Firm* — Oliff and Berridge, PLC

(57) ABSTRACT

An integrated circuit device includes first to Nth memory blocks disposed along a first direction, a power supply circuit, and a data driver disposed in a second direction with respect to the first to Nth memory blocks. The power supply circuit includes an analog reference power supply voltage output circuit that outputs an analog reference power supply voltage. The analog reference power supply voltage output circuit is disposed between an Mth memory block and an (M+1)th memory block among the first to Nth memory blocks. An analog reference power supply line is provided in an area of the data driver along the first direction.

15 Claims, 27 Drawing Sheets

(56) References Cited

U.S. PATENT DOCUMENTS

| | | | | |
|---|---|---|---|---|
| 2005/0057580 | A1* | 3/2005 | Yamano et al. | 345/690 |
| 2005/0184979 | A1* | 8/2005 | Sakaguchi | 345/204 |
| 2005/0243043 | A1* | 11/2005 | Jeoung et al. | 345/87 |
| 2005/0280613 | A1* | 12/2005 | Takei et al. | 345/76 |
| 2006/0145872 | A1* | 7/2006 | Tanaka et al. | 340/572.8 |
| 2006/0284678 | A1* | 12/2006 | Dillon | 330/252 |
| 2007/0091053 | A1* | 4/2007 | Kajiwara et al. | 345/100 |
| 2007/0132702 | A1 | 6/2007 | Kajihara et al. | |
| 2009/0116288 | A1* | 5/2009 | Varkony | 365/185.13 |
| 2009/0160849 | A1* | 6/2009 | Kiya et al. | 345/214 |
| 2009/0160881 | A1* | 6/2009 | Kiya et al. | 345/690 |

OTHER PUBLICATIONS

U.S. Appl. No. 12/340,025, filed Dec. 19, 2008 in the name of Hiroshi Kiya et al.

U.S. Appl. No. 12/251,865, filed Oct. 15, 2008 in the name of Motoaki Nishimura et al.

U.S. Appl. No. 12/251,907, filed Oct. 15, 2008 in the name of Motoaki Nishimura et al.

U.S. Appl. No. 12/251,776, filed Oct. 15, 2008 in the name of Haruo Kamuo et al.

* cited by examiner

FIG. 5A SAMPLE PERIOD
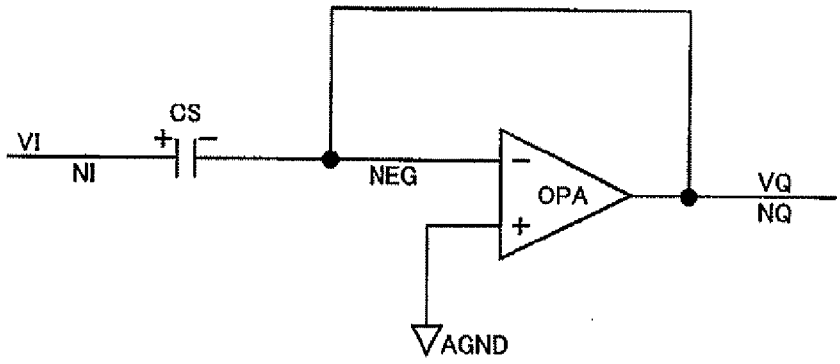
FIG. 5B HOLD PERIOD
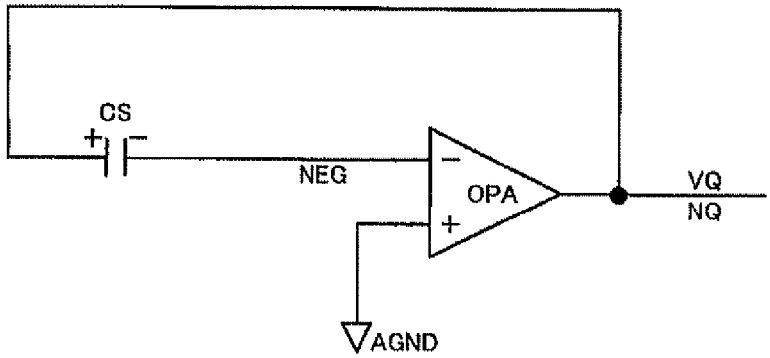
FIG. 5C
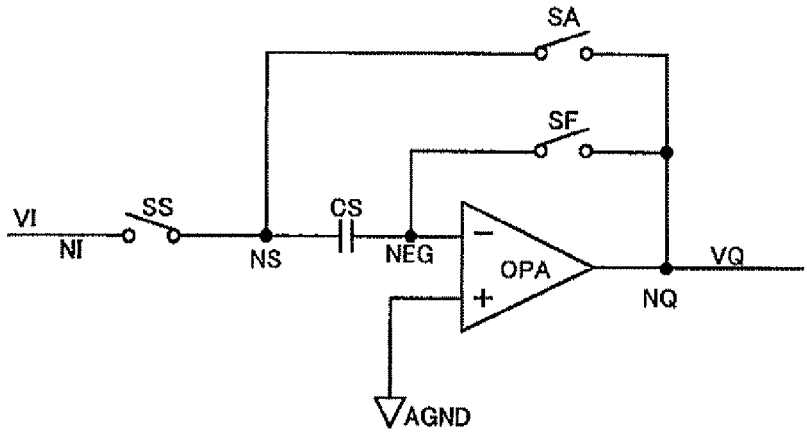

FIG. 22

| GRAYSCALE DATA DG | | | | | | | | VG1 | VG2 | SW1 | SW2 | SW3 | SW4 | VI1 | VI2 | VS |
|---|---|---|---|---|---|---|---|---|---|---|---|---|---|---|---|---|
| D7 | D6 | D5 | D4 | D3 | D2 | D1 | D0 | | | | | | | | | |
| 0 | 0 | 0 | 0 | 0 | 0 | 0 | 0 | V1 | V0 | × (OFF) | ○ (ON) | × (OFF) | ○ (ON) | V0 (VG2) | V0 (VG2) | V0 |
| 0 | 0 | 0 | 0 | 0 | 0 | 0 | 1 | V1 | V0 | ○ | × | × | ○ | V1 (VG1) | V0 (VG2) | $V0-\frac{V0-V1}{2}$ |
| 0 | 0 | 0 | 0 | 0 | 0 | 1 | 0 | V1 | V2 | ○ | × | ○ | × | V1 (VG1) | V1 (VG1) | V1 |
| 0 | 0 | 0 | 0 | 0 | 0 | 1 | 1 | V1 | V2 | × | ○ | ○ | × | V2 (VG2) | V1 (VG1) | $V1-\frac{V1-V2}{2}$ |
| 0 | 0 | 0 | 0 | 0 | 1 | 0 | 0 | V3 | V2 | × | ○ | × | ○ | V2 (VG2) | V2 (VG2) | V2 |
| 0 | 0 | 0 | 0 | 0 | 1 | 0 | 1 | V3 | V2 | ○ | × | × | ○ | V3 (VG1) | V2 (VG2) | $V2-\frac{V2-V3}{2}$ |
| 0 | 0 | 0 | 0 | 0 | 1 | 1 | 0 | V3 | V4 | ○ | × | ○ | × | V3 (VG1) | V3 (VG1) | V3 |
| 0 | 0 | 0 | 0 | 0 | 1 | 1 | 1 | V3 | V4 | × | ○ | ○ | × | V4 (VG2) | V3 (VG1) | $V3-\frac{V3-V4}{2}$ |

FIG. 23A SAMPLE PERIOD
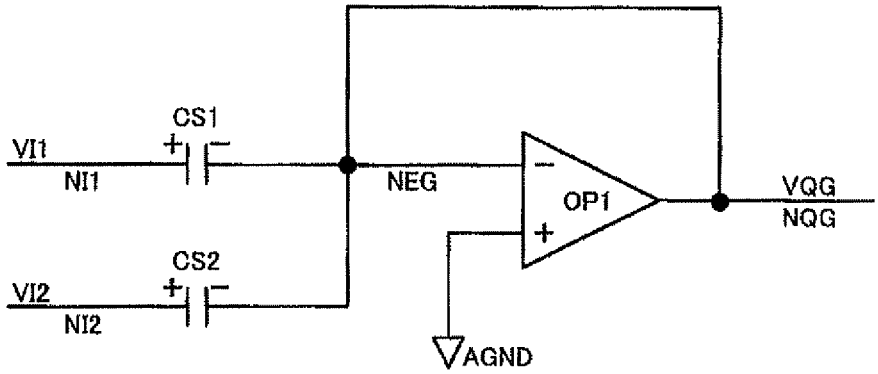
FIG. 23B HOLD PERIOD
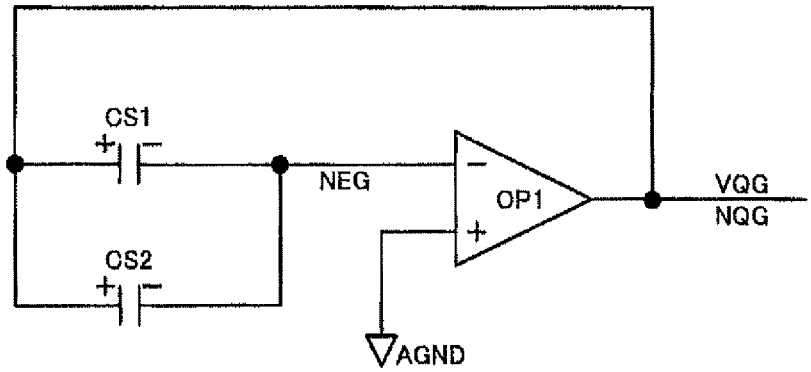

FIG. 24A SAMPLE PERIOD
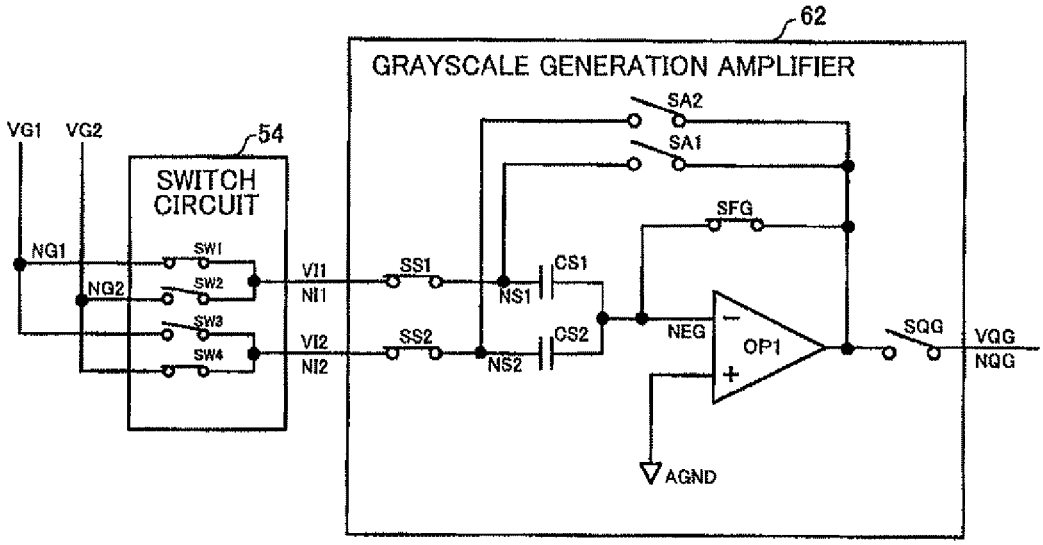
FIG. 24B HOLD PERIOD
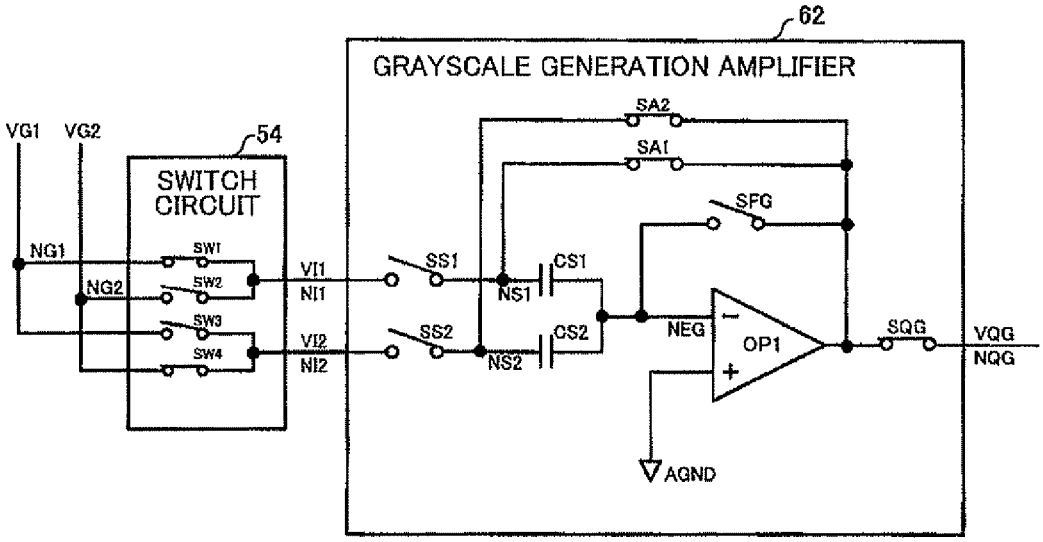

INTEGRATED CIRCUIT DEVICE, ELECTRO-OPTICAL DEVICE, AND ELECTRONIC INSTRUMENT

Japanese Patent Application No. 2007-328572 filed on Dec. 20, 2007, is hereby incorporated by reference in its entirety.

BACKGROUND

The present invention relates to an integrated circuit device, an electro-optical device, an electronic instrument, and the like.

As an electro-optical panel used for electronic instruments (e.g., portable telephone, television, and projector (projection-type display device)), a simple matrix type liquid crystal panel, an active matrix type liquid crystal panel that utilizes a switch element (e.g., thin film transistor), and the like have been known. An electro-optical panel that utilizes a light-emitting element such as an electroluminescence (EL) element has also attracted attention.

In recent years, the number of data lines (source lines) of an electro-optical panel has increased along with an increase in the screen size and the number of pixels of an electro-optical panel. On the other hand, an increase in accuracy of a voltage applied to each data line has been desired. A reduction in power consumption and chip size of a data driver (source driver) that drives data lines of an electro-optical panel has also been desired along with a demand for a reduction in power consumption and weight and size of electronic instruments provided with an electro-optical panel.

For example, JP-A-2005-175811 and JP-A-2005-175812 disclose a configuration that enables a rail-to-rail operation of an output circuit of a data driver that drives a data line while supplying a voltage to the data line with high accuracy.

According to the technologies disclosed in JP-A-2005-175811 and JP-A-2005-175812, the rail-to-rail operation is implemented by controlling the drive capability by providing an auxiliary circuit in each output circuit. Therefore, the circuit scale of the data driver increases due to the addition of the auxiliary circuits Moreover, the transistor size must be increased in order to suppress a variation in voltage applied to the data line. As a result, the chip size increases.

JP-A-2007-243125 discloses a layout method that reduces the chip size by adjacently disposing a data driver block and a memory block along the long side direction of an integrated circuit device.

However, a reduction in chip size and an increase in display characteristics cannot be sufficiently achieved by this layout method.

SUMMARY

According to one aspect of the invention, there is provided an integrated circuit device comprising:

first to Nth (N is an integer equal to or larger than two) memory blocks that are disposed along a first direction and store image data;

a power supply circuit that generates a power supply voltage; and a data driver that is disposed in a second direction with respect to the first to Nth memory blocks and supplies data signals to a plurality of data lines of an electro-optical device, the second direction being a direction that perpendicularly intersects the first direction, the power supply circuit including an analog reference power supply voltage output circuit that outputs an analog reference power supply voltage;

the analog reference power supply voltage output circuit being disposed between an Mth (M is a natural number) memory block and an (M+1)th memory block among the first to Nth memory blocks; and an analog reference power supply line that supplies the analog reference power supply voltage being provided in an area of the data driver along the first direction.

According to another aspect of the invention, there is provided an electro-optical device comprising the above integrated circuit device.

According to another aspect of the invention, there is provided an electronic instrument comprising the above electro-optical device.

BRIEF DESCRIPTION OF THE DRAWINGS

FIGS. 5A to 5C are views illustrative of a flip-around sample-hold circuit.

FIG. 22 is a view illustrative of the operations of a D/A conversion circuit, a switch circuit, and a grayscale generation amplifier.

FIGS. 23A and 23B are views illustrative of a flip-around sample-hold circuit.

FIGS. 24A and 24B show a configuration example of a grayscale generation amplifier using a flip-around sample-hold circuit.

DESCRIPTION OF EXEMPLARY EMBODIMENTS

Figure 1:
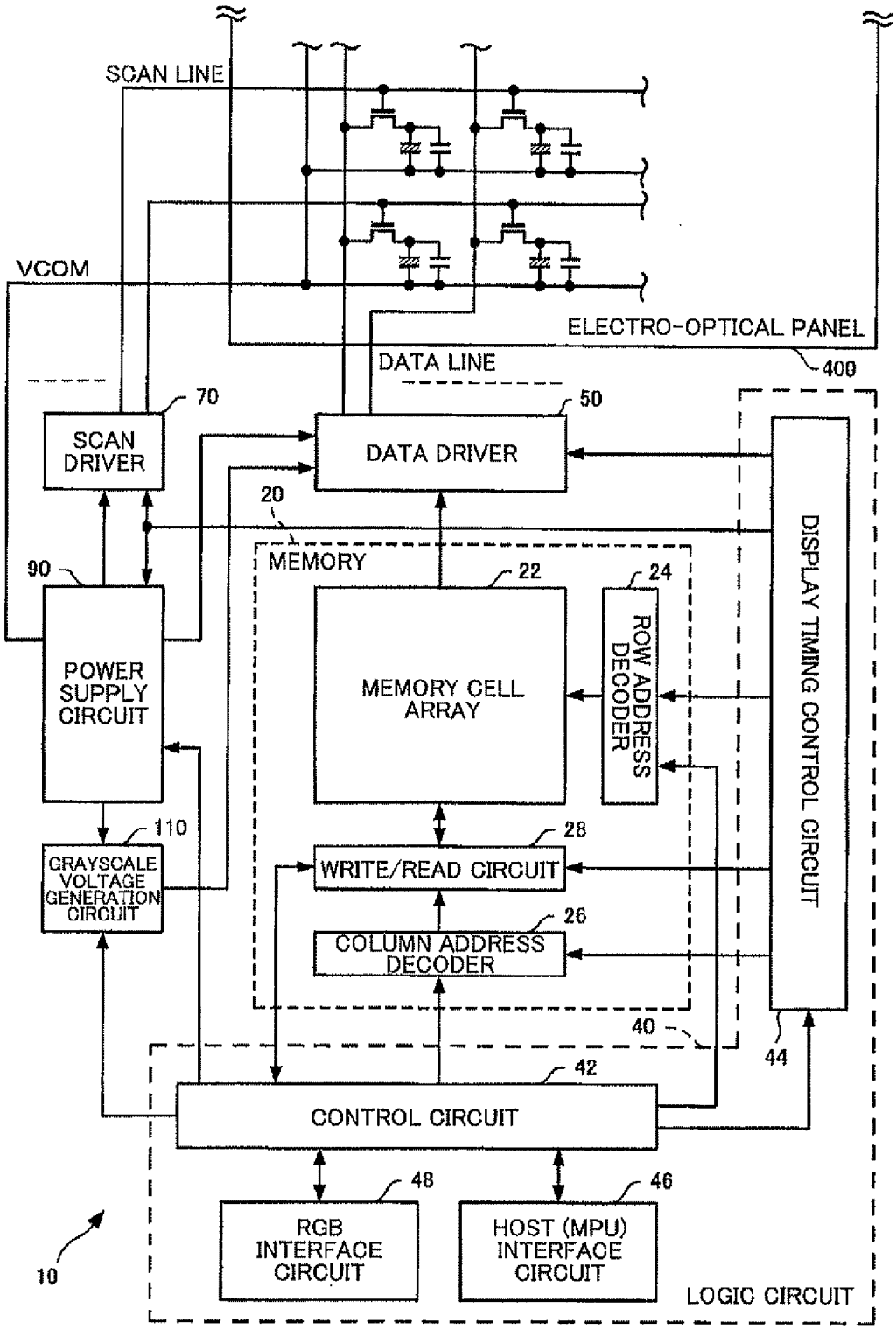
FIG. 1 shows a circuit configuration example of an integrated circuit device according to one embodiment of the invention.

Several aspects of the invention may provide an integrated circuit device, an electro-optical device, and an electronic instrument that can be improved in display characteristics while reducing the circuit scale.

According to one embodiment of the invention, there is provided an integrated circuit device comprising:

first to Nth (N is an integer equal to or larger than two) memory blocks that are disposed along a first direction and store image data;

a power supply circuit that generates a power supply voltage; and a data driver that is disposed in a second direction with respect to the first to Nth memory blocks and supplies data signals to a plurality of data lines of an electro-optical device, the second direction being a direction that perpendicularly intersects the first direction, the power supply circuit including an analog reference power supply voltage output circuit that outputs an analog reference power supply voltage;

the analog reference power supply voltage output circuit being disposed between an Mth (M is a natural number) memory block and an (M+1)th memory block among the first to Nth memory blocks; and an analog reference power supply line that supplies the analog reference power supply voltage being provided in an area of the data driver along the first direction.

According to this embodiment, the data driver is disposed in the second direction with respect to the first to Nth memory blocks disposed along the first direction. The analog reference power supply voltage output circuit included in the power supply circuit is disposed between the Mth memory block and the (M+1)th memory block, and the analog reference power supply line is provided in the area of the data driver along the first direction. Therefore, the analog reference power supply voltage generation circuit can be disposed in an area other than the left end or the right end of the first to Nth memory blocks, for example. As a result, the impedance of the analog reference power supply line provided in the data driver can be made uniform so that a deterioration in display characteristics can be minimized.

In the integrated circuit device, the analog reference power supply voltage may be supplied to a second input terminal of an operational amplifier that is included in the data driver and has a first input terminal and the second input terminal.

According to this configuration, the operational amplifier can perform an amplification operation based on the analog reference power supply voltage.

In the integrated circuit device, the analog reference power supply voltage may be set at a voltage between a high-potential-side power supply voltage and a low-potential-side power supply voltage of the operational amplifier.

According to this configuration, the operational amplifier can perform an appropriate amplification operation based on the analog reference power supply voltage so that the amplification operation of the operational amplifier can be prevented from being saturated, for example.

In the integrated circuit device, the analog reference power supply voltage output circuit may be disposed between an analog reference power supply pad and the data driver, the analog reference power supply pad being connected to a stabilization capacitor that stabilizes the analog reference power supply voltage.

According to this configuration, the analog reference power supply voltage output circuit can be disposed near the analog reference power supply pad connected to the stabilization capacitor so that a change in the analog reference power supply voltage can be suppressed.

In the integrated circuit device, the power supply circuit may include:

a ladder resistor circuit that divides a reference power supply voltage using resistors; and a select circuit that selects a divided voltage among a plurality of divided voltages divided by the ladder resistor circuit, and outputs the divided voltage to the analog reference power supply voltage output circuit, the analog reference power supply voltage output circuit may be disposed between the ladder resistor circuit and the analog reference power supply pad.

According to this configuration, the layout efficiency can be improved while suppressing a change in the analog reference power supply voltage.

In the integrated circuit device, the power supply circuit may include:

a Kth (K is a natural number) voltage-boost circuit disposed between a Kth voltage-boost pad connected to a Kth voltage-boost capacitor and the Mth memory block; and a (K+1)th voltage-boost circuit disposed between a (K+1)th voltage-boost pad connected to a (K+1)th voltage-boost capacitor and the (M+1)th memory block, the analog reference power supply pad may be disposed between the Kth voltage-boost pad and the (K+1)th voltage-boost pad.

According to this configuration, the Kth voltage-boost pad, the analog reference power supply pad, and the (K+1)th voltage-boost pad connected to the capacitors can be disposed collectively so that convenience can be improved, for example.

The integrated circuit device may further comprise:

a logic circuit that controls the power supply circuit and the data driver, a logic circuit pad may be disposed in the first direction with respect to the Kth voltage-boost pad, the analog reference power supply pad, and the (K+1)th voltage-boost pad.

According to this configuration, a situation in which an external line connected to the logic circuit pad hinders connection of the capacitor can be prevented.

In the integrated circuit device, the analog reference power supply voltage may be supplied to a second input terminal of an operational amplifier that is included in a sample-hold circuit included in the data driver and has a first input terminal and the second input terminal.

According to this configuration, the sample-hold circuit can be implemented using the operational amplifier that performs the amplification operation based on the analog reference power supply voltage.

In the integrated circuit device, the data driver may include a grayscale generation amplifier that is configured by a flip-around sample-hold circuit.

The grayscale generation amplifier can be provided with a voltage sample-hold function, and an offset-free state can be implemented by utilizing the flip-around sample-hold circuit. Therefore, a highly accurate voltage that varies to only a small extent can be supplied to the data line.

In the integrated circuit device, the grayscale generation amplifier may include:

the operational amplifier;

a first sampling capacitor that is provided between the first input terminal of the operational amplifier and a first input node of the grayscale generation amplifier and stores a charge corresponding to an input voltage at the first input node in a sample period; and a second sampling capacitor that is provided between the first input terminal of the operational amplifier and a second input node of the grayscale generation amplifier and stores a charge corresponding to an input voltage at the second input node in the sample period, the grayscale generation amplifier may output an output voltage in a hold period, the output voltage corresponding to charges stored in the first sampling capacitor and the second sampling capacitor in the sample period.

According to this configuration, the voltages input to the first input node and the second input node can be sampled into the first sampling capacitor and the second sampling capacitor in the sample period, and the output voltage corresponding to charges stored in the first sampling capacitor and the second sampling capacitor can be output in the hold period by performing the flip-around operation of the first sampling capacitor and the second sampling capacitor.

In the integrated circuit device, the grayscale generation amplifier may include:

the operational amplifier, the analog reference power supply voltage being supplied to the second input terminal of the operational amplifier;

a first sampling switch element and a first sampling capacitor, the first sampling switch element and the first sampling capacitor being provided between a first input node of the grayscale generation amplifier and the first input terminal of the operational amplifier;

a second sampling switch element and a second sampling capacitor, the second sampling switch element and the second sampling capacitor being provided between a second input node of the grayscale generation amplifier and the first input terminal of the operational amplifier;

a feedback switch element provided between an output terminal and the first input terminal of the operational amplifier;

a first flip-around switch element provided between a first connection node and the output terminal of the operational amplifier, the first connection node being situated between the first sampling switch element and the first sampling capacitor; and a second flip-around switch element provided between a second connection node and the output terminal of the operational amplifier, the second connection node being situated between the second sampling switch element and the second sampling capacitor.

According to this configuration, the input voltages can be sampled into the first sampling capacitor and the second sampling capacitor using the first sampling switch element, the second sampling switch element, and the feedback switch element, and the flip-around operation of the first sampling capacitor and the second sampling capacitor can be implemented using the first flip-around switch element and the second flip-around switch element In the integrated circuit device, the first sampling switch element, the second sampling switch element, and the feedback switch element may be turned ON and the first flip-around switch element and the second flip-around switch element may be turned OFF in the sample period; and the first sampling switch element, the second sampling switch element, and the feedback switch element may be turned OFF and the first flip-around switch element and the second flip-around switch element may be turned ON in a hold period.

Since the first sampling switch element, the second sampling switch element, and the feedback switch element are turned ON in the sample period, charges corresponding to the input voltage can be stored in the first sampling capacitor and the second sampling capacitor utilizing the virtual short-circuit function of the operational amplifier. Since the first flip-around switch element and the second flip-around switch element are turned ON in the hold period, an output voltage corresponding to charges stored in the first sampling capacitor and the second sampling capacitor can be output to the output node of the grayscale generation amplifier.

In the integrated circuit device, the first sampling switch element and the second sampling switch element may be turned OFF after the feedback switch element has been turned OFF.

This minimizes an adverse effect of charge injection via the first sampling switch element, the second sampling switch element, and the like.

In the integrated circuit device, the analog reference power supply voltage supplied to the second input terminal of the operational amplifier may be set at a voltage between a high-potential-side power supply voltage and a low-potential-side power supply voltage of switch control signals supplied to the first sampling switch element, the second sampling switch element, the feedback switch element, the first second flip-around switch element, and the second flip-around switch element.

An adverse effect of charge injection can be further reduced by thus setting the analog reference power supply voltage.

According to another embodiment of the invention, there is provided an electro-optical device comprising one of the above integrated circuit devices.

According to another embodiment of the invention, there is provided an electronic instrument comprising the above electro-optical device.

Preferred embodiments of the invention are described in detail below Note that the following embodiments do not in any way limit the scope of the invention defined by the claims laid out herein. Note that all elements of the following embodiments should not necessarily be taken as essential requirements for the invention.

1. Circuit Configuration of Integrated Circuit Device

FIG. 1 shows a circuit configuration example of an integrated circuit device 10 (driver) according to one embodiment of the invention. Note that the integrated circuit device 10 according to this embodiment is not limited to the configuration shown in FIG. 1. Various modifications may be made such as omitting some of the elements (e.g., scan driver, grayscale voltage generation circuit, or logic circuit) or adding other elements.

An electro-optical panel 400 (electro-optical device) includes a plurality of data lines (e.g., source lines), a plurality of scan lines (e.g., gate lines), and a plurality of pixels specified by the data lines and the scan lines. A display operation is implemented by changing the optical properties of an electro-optical element (liquid crystal element, EL element, or the like in a narrow sense) in each pixel area. The electro-optical panel (display panel in a narrow sense) may be formed using an active matrix type panel utilizing a switch element such as a TFT or TFD, for example. The electro-optical panel may be a panel other than the active matrix type panel, or may be a panel using a light-emitting element such as an organic electroluminescence (EL) element or an inorganic EL element.

A memory 20 (display data RAM) stores image data. A memory cell array 22 includes a plurality of memory cells. The memory cell array 22 stores image data (display data) corresponding to at least one frame (one screen). A row address decoder 24 (MPU/LCD row address decoder) decodes a row address, and selects a wordline of the memory cell array 22. A column address decoder 26 (MPU column address decoder) decodes a column address, and selects a bitline of the memory cell array 22. A write/read circuit 28 (MPU write/read circuit) writes image data into the memory cell array 22, or reads image data from the memory cell array 22.

A logic circuit 40 (driver logic circuit) generates a control signal that controls a display timing, a control signal that controls a data processing timing, and the like. The logic circuit 40 may be formed by automatic placement and routing (e.g., gate array (G/A)), for example.

A control circuit 42 generates various control signals, and controls the entire device. Specifically, the control circuit 42 outputs grayscale adjustment data (gamma correction data) that adjusts grayscale characteristics (gamma characteristics) to a grayscale voltage generation circuit 110, and outputs power supply adjustment data that adjusts a power supply voltage to a power supply circuit 90. The control circuit 42 also controls a memory write/read process using the row address decoder 24, the column address decoder 26, and the write/read circuit 28.

A display timing control circuit 44 generates various control signals that control the display timing, and controls reading of image data from the memory 20 into the electro-optical panel 400. A host (MPU) interface circuit 46 implements a host interface that generates an internal pulse corresponding to each access from a host and accesses the memory 20. An RGB interface circuit 48 implements an RGB interface that writes motion picture RGB data into the memory 20 based on a dot clock signal. Note that the integrated circuit device 10 may be configured to include only one of the host interface circuit 46 and the RGB interface circuit 48.

A data driver 50 is a circuit that generates a data signal (voltage or current) supplied to the data line of the electro-optical panel 400 (electro-optical device). Specifically, the data driver 50 receives image data (grayscale data or display data) from the memory 20, and receives a plurality of (e.g., 256-stage) grayscale voltages (reference voltages) from the grayscale voltage generation circuit 110. The data driver 50 selects a voltage (data voltage) corresponding to the image data (grayscale data) from the plurality of grayscale voltages, and outputs the selected voltage to the data line of the electro-optical panel 400.

A scan driver 70 generates a scan signal that drives the scan line of the electro-optical panel 400. Specifically, the scan driver 70 sequentially shifts a signal (enable input-output signal) using a shift register provided therein, and outputs a signal obtained by converting the level of the shifted signal to each scan line of the electro-optical panel 400 as the scan signal (scan voltage). The scan driver 70 may include a scan address generation circuit and an address decoder. The scan address generation circuit may generate and output a scan address, and the address decoder may decode the scan address to generate the scan signal.

Figure 2A:
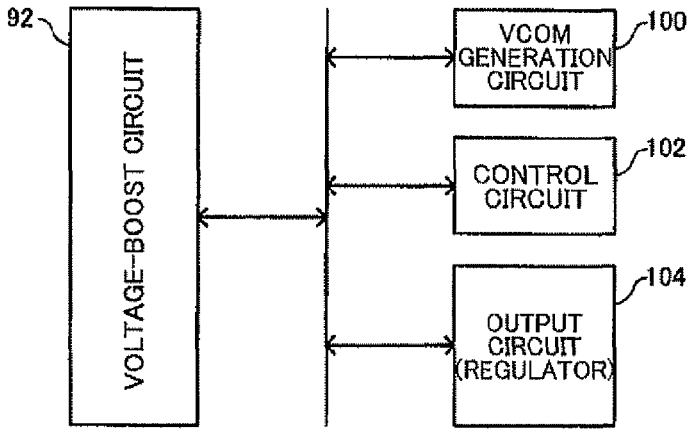
FIGS. 2A and 2B show configuration examples of a power supply circuit and a grayscale voltage generation circuit.
Figure 2B:
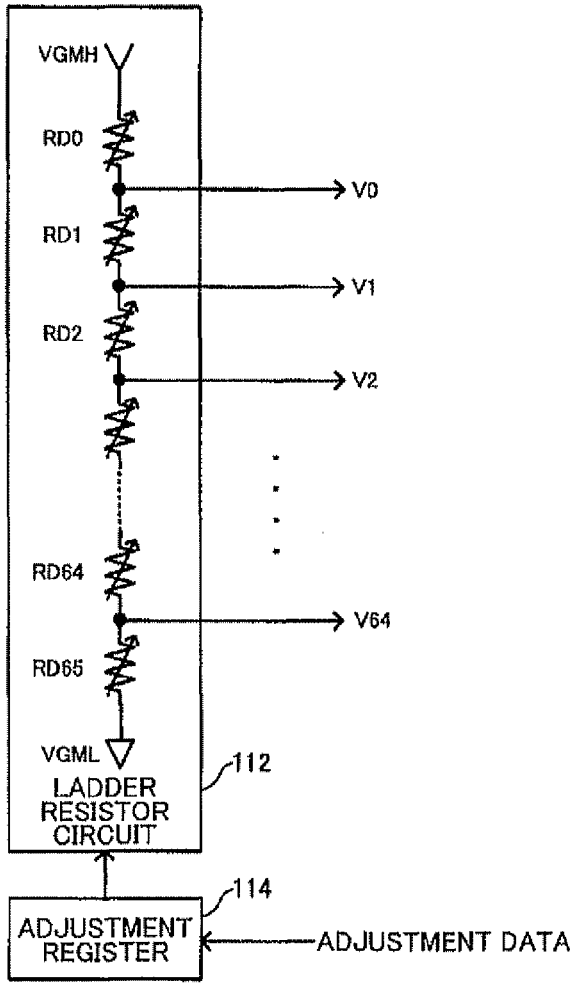

The power supply circuit 90 is a circuit that generates various power supply voltages. FIG. 2A shows a configuration example of the power supply circuit 90. A voltage-boost circuit 92 is a circuit that boosts an input power supply voltage or an internal power supply voltage by a charge-pump method using a boost capacitor and a boost transistor to generate a boosted voltage. The voltage-boost circuit 92 may include first to fourth voltage booster circuits and the like. A high voltage used in the scan driver 70 and the grayscale voltage generation circuit 110 can be generated by the voltage-boost circuit 92. A VCOM generation circuit 100 generates and outputs a voltage VCOM supplied to a common electrode of the electro-optical panel 400. A control circuit 102 controls the power supply circuit 90, and includes various control registers and the like. An output circuit 104 (regulator circuit or power supply voltage supply circuit) adjusts the boosted voltage generated by the voltage-boost circuit 92, for example, and outputs various power supply voltages, The grayscale voltage generation circuit (gamma correction circuit) 110 is a circuit that generates the grayscale voltage. FIG. 2B shows a configuration example of the grayscale voltage generation circuit 110. A ladder resistor circuit 112 (voltage divider circuit) generates and outputs grayscale voltages V0 to V64 based on grayscale-voltage-generation power supply voltages VGMH and VGML generated by the power supply circuit 90. Specifically, the ladder resistor circuit 112 includes a plurality of resistors RD0 to RD65 connected in series between the power supply voltages VGMH and VGML, and outputs the grayscale voltages V0 to V64 to taps between the resistors RD0 to RD65. The resistors RD0 to RD65 are variable resistors. The resistances of the resistors RD0 to RD65 are set based on the grayscale adjustment data set in an adjustment register 114. Therefore, grayscale voltages having grayscale characteristics (gamma correction characteristics) optimum for the type of the electro-optical panel 400 and the like can be generated.

When performing polarity inversion drive, the grayscale voltages V0 to V64 may be caused to differ between a positive period (first period in a broad sense) and a negative period (second period in a broad sense). In this case, the grayscale voltages in the positive period and the grayscale voltages in the negative period may be generated by changing the resistances of the resistors RD0 to RD65 of the ladder resistor circuit 112 based on the grayscale adjustment data.

The grayscale characteristics may be caused to differ corresponding to R (first color component in a broad sense), G (second color component in a broad sense), and B (third color component in a broad sense). When causing the grayscale characteristics (gamma characteristics) to differ corresponding to R, G, and B, the grayscale voltage generation circuit 110 may output R grayscale voltages in an R (red) sample period of a sample-hold circuit included in the data driver 50, may output G grayscale voltages in a G (green) sample period of the sample-hold circuit, and may output B grayscale voltages in a B (blue) sample period of the sample-hold circuit. In this case, the R, G, and B grayscale voltages may be generated by changing the resistances of the resistors RD0 to RD65 of the ladder resistor circuit 112 based on the grayscale data.

The configuration of the grayscale voltage generation circuit 110 is not limited to the configuration shown in FIG. 2B. Various modifications may be made such as providing a circuit (e.g., operational amplifier) that subjects the grayscale voltages V0 to V64 to impedance conversion, providing a plurality of ladder resistor circuits corresponding to the positive period and the negative period, or providing a plurality of ladder resistor circuits corresponding to R, G, and B.

2. Layout of Integrated Circuit Device

Figure 3:
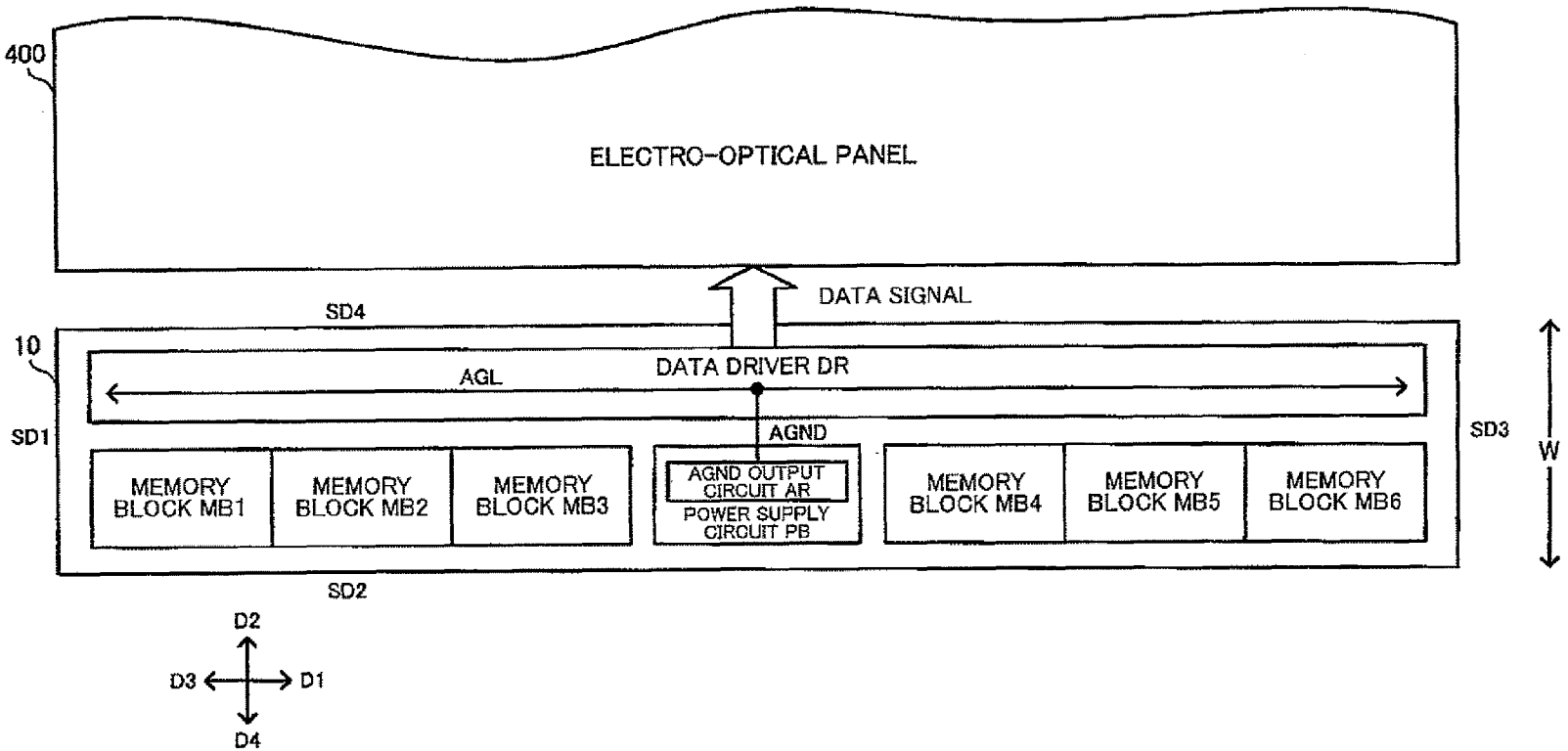
FIG. 3 shows a layout example of an integrated circuit device according to one embodiment of the invention.

FIG. 3 shows a layout example of the integrated circuit device 10 according to this embodiment. In FIG. 3, the direction from a first side SD1 (short side) of the integrated circuit device 10 toward a third side SD3 opposite to the first side SD1 is referred to as a first direction D1, and the direction opposite to the first direction D1 is referred to as a third direction D3. The direction from a second side SD2 (long side) of the integrated circuit device 10 toward a fourth side SD4 opposite to the second side SD2 is referred to as a second direction D2, and the direction opposite to the second direction D2 is referred to as a fourth direction D4. In FIG. 3, the left side of the integrated circuit device 10 is the first side SD1, and the right side of the integrated circuit device 10 is the third side SD3. Note that the left side of the integrated circuit device 10 may be the third side SD3, and the right side of the integrated circuit device 10 may be the first side SD1.

The integrated circuit device 10 shown in FIG. 3 includes a plurality of memory blocks MB1 to MB6 (first to Nth memory blocks in a broad sense; N is an integer equal to or larger than two). The memory blocks MB1 to MB6 store image data for displaying an image. The memory blocks MB1 to MB6 are disposed (arranged) along the direction D1.

Specifically, the memory 20 shown in FIG. 1 is divided into the memory blocks MB1 to MB6 in a bank. The memory blocks MB1 to MB6 (memory cell arrays) store image data corresponding to data signals supplied to a first data line group to a sixth data line group of the electro-optical panel 400, respectively. Note that the number of memory blocks (MB1 to MB6) is not limited to six, but may be an arbitrary number. The column address decoder, the row address decoder, a sense amplifier block, and the like provided in each memory block together with the memory cell array may be independently provided in each memory block. Alternatively, the memory blocks may share some or all of the column address decoder, the row address decoder, a sense amplifier block, and the like.

The integrated circuit device 10 includes a power supply circuit PB that generates a power supply voltage. The power supply circuit PB has the configuration described with reference to FIGS. 1 and 2A, for example. In FIG. 3, the power supply circuit PB is provided between the memory blocks MB3 and MB4. Note that the power supply circuit PB may be partially provided in the direction D4 with respect to the memory blocks MB1 to MB6. For example, a voltage-boost circuit (voltage-boost transistor) of the power supply circuit PB may be formed in a narrow area between the memory blocks MB1 to MB6 and a pad arrangement area provided in the direction D4 with respect to the memory blocks MB1 to MB6.

The integrated circuit device 10 includes a data driver DR. The data driver DR is disposed in the direction D2 with respect to the memory blocks MB1 to MB6, and supplies data signals (data voltages or data currents) to the data lines of the electro-optical panel 400 (electro-optical device).

Specifically, the data driver DR (data driver block and sub-driver block) may include a latch circuit (pre-latch circuit and post-latch circuit), a D/A conversion circuit (DAC), a data line driver circuit (driver cell, output circuit, and buffer circuit), and the like. The latch circuit, the D/A conversion circuit, and the data line driver circuit may be provided corresponding to each data line (each subpixel or each pixel) of the electro-optical panel 400, for example. The latch circuit, the D/A conversion circuit, or the data line driver circuit may be shared by a plurality of data lines.

The latch circuits included in the data driver DR latch image data (subpixel image data) output from the memory blocks MB1 to MB6 (memories). The D/A conversion circuit D/A-converts the latched digital image data to generate an analog data signal. Specifically, the D/A conversion circuit receives a plurality of grayscale voltages (reference voltages) from the grayscale voltage generation circuit 110 shown in FIG. 1, selects a grayscale voltage corresponding to the digital image data from the plurality of grayscale voltages, and outputs the selected grayscale voltage as the data signal (data voltage). The data line driver circuit buffers the data signal output from the D/A conversion circuit using an operational amplifier or the like, and outputs the data signal to the data line of the electro-optical panel 400 to drive the data line. When the electro-optical panel 400 is a low-temperature polysilicon TFT liquid crystal panel or the like, the data line driver circuit may multiplex R, G, and B data signals and output the R, G, and B data signals by time division. This makes it possible to reduce the number of data signal pads (terminals in a broad sense). The data driver DR may include a plurality of data driver blocks (described later). In this case, each data driver block receives the image data stored in the corresponding memory block among the plurality of memory blocks, and drives the data line.

As shown in FIG. 3, the power supply circuit PB includes an AGND output circuit AR (analog reference power supply voltage output circuit or analog reference power supply voltage regulator) that outputs (supplies) an analog reference power supply voltage AGND. The AGND output circuit AR may include an operational amplifier that reduces the output impedance of the analog reference power supply voltage AGND, for example. The AGND output circuit AR may also include an adjustment circuit that adjusts the voltage level of the analog reference power supply voltage AGND The analog reference power supply voltage AGND is a voltage (intermediate voltage) between a high-potential-side power supply voltage and a low-potential-side power supply voltage (e.g., power supply voltages of an operational amplifier included in the data driver), for example. The analog reference power supply voltage AGND is a power supply voltage that serves as a reference for the operation of an analog circuit (e.g., a power supply voltage that serves as a reference for signal amplification of an operational amplifier), for example.

As shown in FIG. 3, the AGND output circuit AR power supply circuit PB) is disposed between the memory blocks MB3 and MB4 (between the Mth memory block and the (M+1)th memory block among the first to Nth memory blocks in a broad sense; M is a natural number). Specifically, the AGND output circuit AR (AGND generation circuit) is disposed near the center (at the center) of the integrated circuit device 10. For example, a line along the short side SD1 of the integrated circuit device 10 is referred to as a first line, a line along the short side SD3 is referred to as a second line, and a line that passes through the center between the first line and the second line is referred to as a center line. A line that passes through the center between the first line and the center line is referred to as a third line, and a line that passes through the center between the second line and the center line is referred to as a fourth line. In this case, the AGND output circuit AR is disposed in an area between the third line and the fourth line, for example.

In FIG. 3, an AGND line AGL (analog reference power supply line) that supplies the analog reference power supply voltage AGND is provided in the data driver DR along the direction D1. Specifically, the AGND line AGL is pulled out from the AGND output circuit AR to the data driver DR along the direction D2 through a pull-out line, then turns at right angles, and extends along the direction D1 and the direction D3. The AGND line AGL is provided over the data driver DR (area of the data driver DR) along the direction D1. In this case, a plurality of AGND lines may be provided along the direction D1.

Figure 4A:
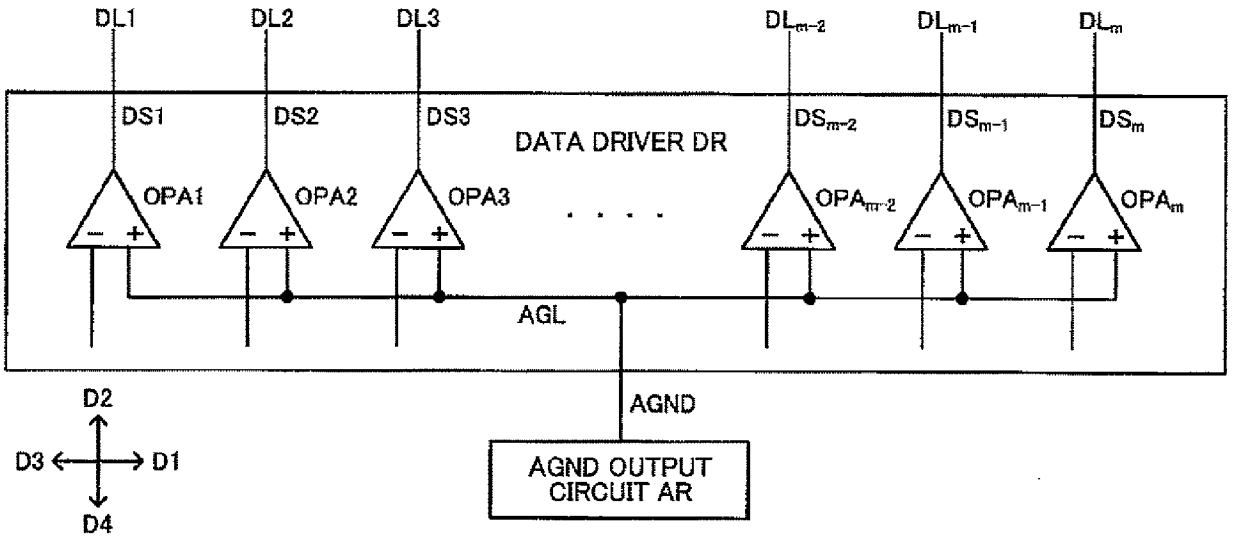
FIGS. 4A and 4B are views illustrative of an operational amplifier included in a data driver.

FIG. 4A schematically shows the internal configuration of the data driver DR. As shown in FIG. 4A, the data driver DR includes a plurality of operational amplifiers OPA1 to OPAm (m is an integer equal to or larger than two). The operational amplifiers OPA1 to OPAm subject data signals DS1 to DSm supplied to data lines DL1 to DLm to impedance conversion, for example. Specifically, the operational amplifiers OPA1 to OPAm are used to reduce the output impedances of the data signals DS1 to DSm to drive th data lines DL1 to DLm at a low impedance. As shown in FIG. 4A, the analog reference power supply voltage AGND is supplied to one (e.g., non-inverting input terminal) of an inverting input terminal (first input terminal in a broad sense) and a non-inverting input terminal (second input terminal in a broad sense) of the operational amplifier OPA (OPA1 to OPAm) included in the data driver DR, for example. Note that a modification in which the analog reference power supply voltage AGND is supplied the inverting input terminal is also possible. In FIG. 4A, the operational amplifier is provided corresponding to each data line. Note that the operational amplifier may be provided corresponding to a plurality of data lines. A switch element and another operational amplifier may be provided between an output terminal of the operational amplifier and the data line.

Figure 4B:
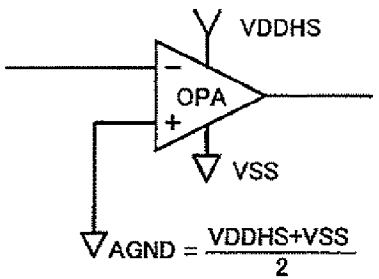

As shown in FIG. 4B, the analog reference power supply voltage AGND is set at (adjusted to) a voltage (intermediate voltage) between a high-potential-side power supply voltage VDDHS and a low-potential-side power supply voltage VSS of the operational amplifier OPA (OPA1 to OPAm). Specifically, the analog reference power supply voltage AGND is set at VSS+(VDDHS+VSS)/ML, for example. When VSS=0 V and ML=2, the analog reference power supply voltage AGND is (VDDHS+VSS)/2. Note that the coefficient ML need not necessarily be two (ML=2). The coefficient ML may be appropriately adjusted corresponding to the display characteristics and the like. It suffices that the coefficient ML be larger than one (ML>1).

The power supply voltage VDDHS is a voltage supplied to the source of a high-potential-side P-type transistor included in the operational amplifier OPA, and the power supply voltage VSS is a voltage supplied to the source of a low-potential-side N-type transistor included in the operational amplifier OPA, for example. The operational amplifier OPA operates using the power supply voltages VDDHS and VSS as operating power supply voltages.

A related-art integrated circuit device used as a driver does not generate the analog reference power supply voltage AGND used in this embodiment, and does not use an operational amplifier to which the analog reference power supply voltage AGND is supplied at its input terminal. Specifically, a voltage-follower-connected operational amplifier has been used as an operational amplifier of a data driver. When using a voltage-follower-connected operational amplifier, it is necessary to employ a rail-to-rail operational amplifier in order to cause the output voltage to swing to the maximum extent by eliminating a dead zone.

However, since an auxiliary circuit must be provided in a rail-to-rail operational amplifier as an additional circuit, the circuit scale and power consumption increase.

A voltage-follower-connected operational amplifier also has a disadvantage in that the voltage of the data signal changes due to the offset voltage of the operational amplifier. Therefore, the voltage of the data line varies due to the offset voltage so that a deterioration in display characteristics (e.g., display non-uniformity) occurs.

In this case, a DAC drive operation that directly drives the data line using a D/A conversion circuit (grayscale voltage generation circuit) after driving the data line using the operational amplifier may be employed. However, when employing the DAC drive operation, the drive period becomes insufficient due to insufficient current supply capability. This makes it difficult to deal with a large panel or causes an increase in power consumption.

According to this embodiment, since the operational amplifier that utilizes the analog reference power supply voltage AGND is used, the amplification operation is performed based on the analog reference power supply voltage AGND, for example. Therefore, the amplification operation of the operational amplifier can be prevented from being saturated so that a rail-to-rail operational amplifier or the like need not be employed. Therefore, the circuit scale and power consumption can be reduced.

The operational amplifier that utilizes the analog reference power supply voltage AGND may be used for a sample-hold circuit (described later). The offset voltage can be canceled by employing a flip-around sample-hold circuit or the like, differing from a voltage-follower-connected operational amplifier, so that an offset-free state can be implemented. The above-described DAC drive operation becomes unnecessary by implementing an offset-free state. Therefore, the circuit scale and power consumption can be reduced while improving the display characteristics, When utilizing the analog reference power supply voltage AGND, the voltage of the data signal changes when the voltage level of the analog reference power supply voltage AGND changes. Since a memory block and a data driver are disposed at the center of an integrated circuit device used as a driver, a power supply circuit is generally disposed on the left end or the right end of the integrated circuit device.

When the power supply circuit is disposed on the left end of the integrated circuit device, for example, the AGND output circuit is also disposed on the left end of the integrated circuit device. In this case, the impedance of the AGND line differs between the left end and the right end. Therefore, the voltage of the data signal may differ between the left end and the right end so that the display characteristics may deteriorate.

In FIG. 3, since the AGND output circuit AR (power supply circuit PB) is disposed between the memory blocks MB3 and MB4, the AGND output circuit AR can be disposed near the center of the integrated circuit device 10. Therefore, the impedance of the AGND line can be made uniform as compared with the method that disposes the AGND output circuit AR on the left end or the right end of the integrated circuit device 10. As a result, a change in the voltage of the data signal can be minimized. Therefore, a deterioration in display characteristics can be minimized while suppressing an increase in circuit scale and power consumption, for example.

3. Sample-hold Circuit

Each of the operational amplifiers OPA1 to OPAm shown in FIG. 4A and the like may be used for a sample-hold circuit included in the data driver DR, for example. A flip-around sample-hold circuit may be used as the sample-hold circuit, for example.

The flip-around sample-hold circuit is described in detail below with reference to FIGS. 5A and 5B.

In FIGS. 5A and 5B, the flip-around sample-hold circuit includes an operational amplifier OPA and a sampling capacitor CS. The sampling capacitor CS is provided between an inverting input terminal (first input terminal in a broad sense) of the operational amplifier OPA and an input node NI of the sample-hold circuit. As shown in FIG. 5A, a charge corresponding to an input voltage VI at the input node NI is stored in the capacitor CS in the sample period.

As shown in FIG. 5A, the output from the operational amplifier OPA is fed back to a node NEG of the inverting input terminal of the operational amplifier OPA in a sample period. The analog reference power supply voltage AGND is supplied to a non-inverting input terminal (second input terminal in a broad sense) of the operational amplifier OPA. Therefore, the node NEG connected to one end of the capacitor CS is set at the analog reference power supply voltage AGND due to a virtual short circuit function of the operational amplifier OPA. Therefore, a charge corresponding to the input voltage VI is stored in the capacitor CS.

As shown in FIG. 5B, the sample-hold circuit outputs an output voltage VQ corresponding to the charge stored in the sampling capacitor CS in the sample period to its output node NQ in a hold period. Specifically, the sample-hold circuit outputs the output voltage VQ corresponding to the charge stored in the capacitor CS by performing a flip-around operation that connects the other end of the capacitor CS of which one end is connected to the node NEG to an output terminal of the operational amplifier OPA.

An offset-free state can be implemented by utilizing the above-described flip-around sample-hold circuit (details are described later). Therefore, a variation in output voltage between the data lines can be minimized so that an accurate voltage that varies to only a small extent can be supplied to the data line. As a result, the display quality can be improved. Moreover, since the DAC drive operation that directly drives the data line using the D/A conversion circuit becomes unnecessary, high-speed drive and simplified control can be implemented.

FIG. 5C shows a detailed configuration example of the flip-around sample-hold circuit. The sample-hold circuit includes the operational amplifier OPA, a sampling switch element SS, the sampling capacitor CS, a feedback switch element SF, and a flip-around switch element SA. Note that modifications may be made such as omitting some of the elements or adding other elements. The switch elements SS, SA, and SF may be formed by CMOS transistors (e.g., transfer gate), for example.

The analog reference power supply voltage AGND is supplied to the non-inverting input terminal (second input terminal) of the operational amplifier OPA.

The sampling switch element SS and the sampling capacitor CS are provided between the input node NI of the sample-hold circuit and the inverting input terminal (first input terminal) of the operational amplifier OPA. The feedback switch element SF is provided between the output terminal and the inverting input terminal of the operational amplifier OPA.

The flip-around switch element SA is provided between a connection node NS situated between the switch element SS and the capacitor CS, and the output terminal of the operational amplifier OPA.

In the sample period, the sampling switch element SS and the feedback switch element SF are turned ON, and the flip-around switch element SA is turned OFF, as shown in FIG. 5A. This implements a sample operation of the flip-around sample-hold circuit.

In the hold period, the sampling switch element SS and the feedback switch element SF are turned OFF, and the flip-around switch element SA is turned ON, as shown in FIG. 5B. This implements a hold operation of the flip-around sample-hold circuit.

In the flip-around sample-hold circuit shown in FIG. 5C, charge injection may occur due to the feedback switch element SF (details are described later). However, imbalance between the amount of charge from the N-type transistor and the amount of charge from the P-type transistor of the transfer gate of the feedback switch element SF can be reduced by supplying the analog reference power supply voltage AGND (i.e., a voltage between the high-potential-side power supply voltage VDDHS and the low-potential-side power supply voltage VSS) to the non-inverting input terminal of the operational amplifier OPA, as shown in FIG. 4B. This minimizes an adverse effect of charge injection that may occur when the switch element SF is turned OFF.

In the flip-around sample-hold circuit shown in FIG. 5C, the output voltage VQ of the operational amplifier OPA changes when the analog reference power supply voltage AGND changes. As a result, the voltage of the data signal also changes.

On the other hand, since the impedance of the AGND line can be made uniform by providing the AGND line AGL as shown in FIG. 3, a change in the analog reference power supply voltage AGND supplied to the inverting input terminal of the operational amplifier OPA can be minimized. As a result, a change in the voltage of the data signal can also be minimized so that a deterioration in display quality can be prevented.

4. Layout of Data Driver Block and Memory Block

The data driver DR shown in FIG. 3 may include a plurality of data driver blocks. A layout example of the data driver blocks and the memory blocks employed in this case is described below with reference to FIG. 6.

Figure 6:
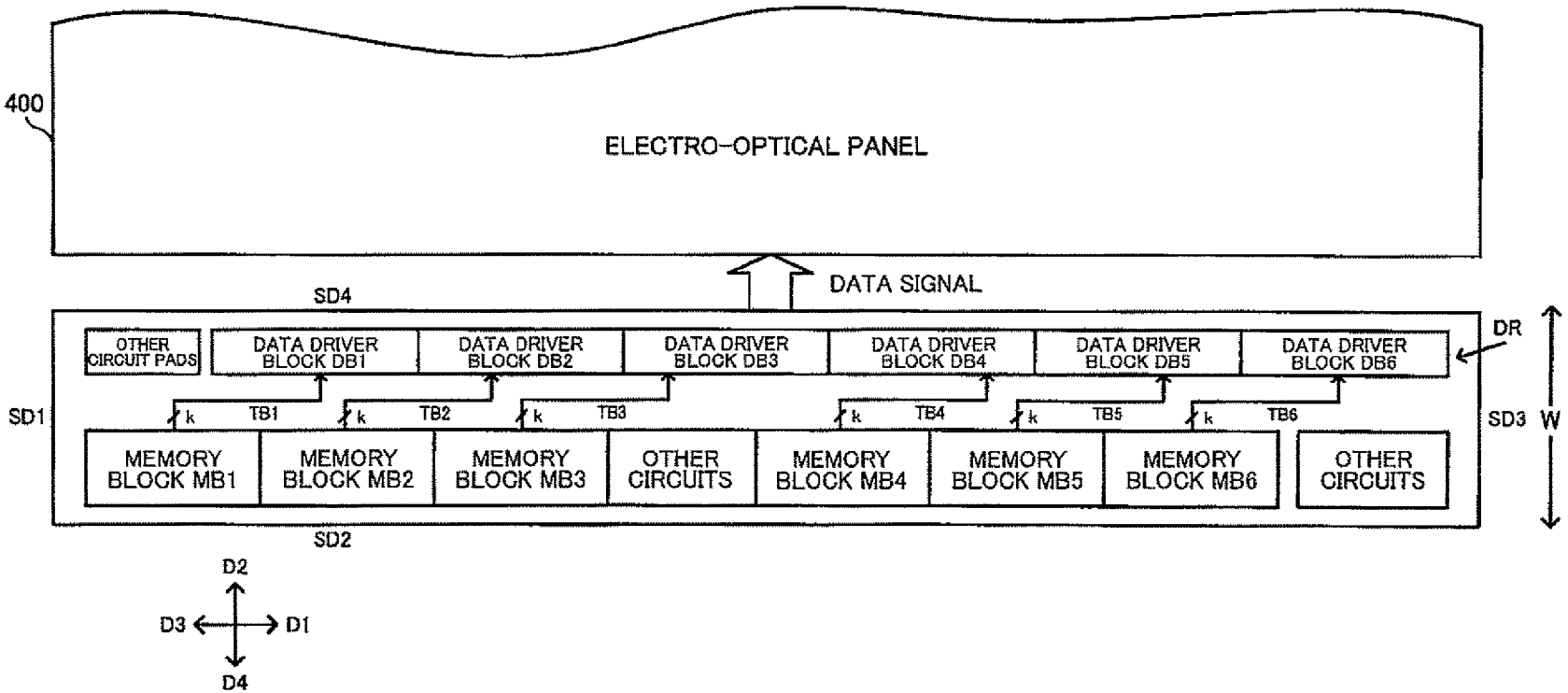
FIG. 6 shows a layout example of memory blocks and data driver blocks.

In FIG. 6, the memory blocks MB1 to MB6 (first to Nth memory blocks in a broad sense) are disposed along the direction D1, and store image data.

Data driver blocks DB1 to DB6 (first to Nth data driver blocks in a broad sense) are disposed along the direction D1. Specifically, the data driver blocks DB1 to DB6 are disposed along the direction D1 in the direction D2 with respect to the memory blocks MB1 to MB6. The data driver blocks DB1 to DB6 supply the data signals to the data lines of the electro-optical panel 400 (electro-optical device). The memory block MB1 stores image data necessary for the data driver block DB1 to generate the data signals, and the memory block MB2 stores image data necessary for the data driver block DB2 to generate the data signals. Likewise, the memory blocks MB3 to MB6 store image data necessary for the data driver blocks DB3 to DB6 to generate the data signals.

The memory block MB1 (Jth memory block in a broad sense; J is an integer that satisfies $1 \leq J \leq N$) among the memory blocks MB1 to MB6 (first to Nth memory blocks) dot-sequentially reads subpixel image data (i.e., image data corresponding to at least one subpixel (e.g., image data corresponding to one to eight subpixels) from the memory cell array. The memory block MB1 outputs the read subpixel image data by time division to the corresponding data driver block DB1 (Jth data driver block in a broad sense) among the data driver blocks DB1 to DB6. Specifically, the image data is dot-sequentially read from a port of the memory block MB1 (data driver-side port) instead of line-sequentially reading the image data.

Specifically, a k-bit (k is a natural number; e.g., k=8, 16, or 32) data transfer bus TB1 that transfers the subpixel image data (R, G, and B image data) by time division is provided between the memory block MB1 and the data driver block DB1. The k-bit subpixel image data is transferred through the data transfer bus TB1.

The data driver block DB1 receives the subpixel image data from the memory block MB1, and outputs the data signals corresponding to the subpixel image data.

Likewise, the memory block MB2 dot-sequentially reads the subpixel image data, and outputs the subpixel image data to the corresponding data driver block DB2 by time division. Specifically, a k-bit data transfer bus TB2 that transfers the subpixel image data by time division is provided between the memory block MB2 and the data driver block DB2. The k-bit subpixel image data is transferred through the data transfer bus TB2.

The data driver block DB2 receives the subpixel image data from the memory block MB2, and outputs the data signals corresponding to the subpixel image data.

Likewise, the subpixel image data is transferred by time division between the memory blocks MB3 to MB6 and the corresponding data driver blocks DB3 to DB6 through data transfer buses TB3 to TB6.

Note that the subpixel image data is transferred in parallel between the memory blocks MB1 to MB6 and the data driver blocks DB1 to DB6 in each horizontal scan period. For example, the image data supplied to the subpixels corresponding to the intersection points of the first scan line and the second data line group adjacent to the first data line group is transferred between the memory block MB2 and the data driver block DB2 in a period in which the image data supplied to the subpixels corresponding to the intersection points of the first scan line and the first data line group is transferred between the memory block MB1 and the data driver block DB1. The above description also applies to data transfer between the memory blocks MB3 to MB6 and the data driver blocks DB3 to DB6, respectively.

According to this embodiment, the image data is dot-sequentially read from the memory (RAM) instead of line-sequentially reading the image data from the memory. The subpixel image data that is dot-sequentially read from each memory block is transferred to the corresponding data driver block by time division. This eliminates the dependence on the positional relationship between the memory blocks MB1 to MB6 and the data driver blocks DB1 to DB6 so that the data driver blocks DB1 to DB6 can be disposed without being affected by the layout of the memory blocks MB1 to MB6. Therefore, the degree of freedom relating to the layout can be increased so that the layout efficiency can be improved. As a result, the width W of the integrated circuit device 10 in the direction D2 can be reduced so that a narrow chip can be implemented. This reduces the chip area of the integrated circuit device 10, and facilitates mounting of the integrated circuit device 10.

Figure 7A:
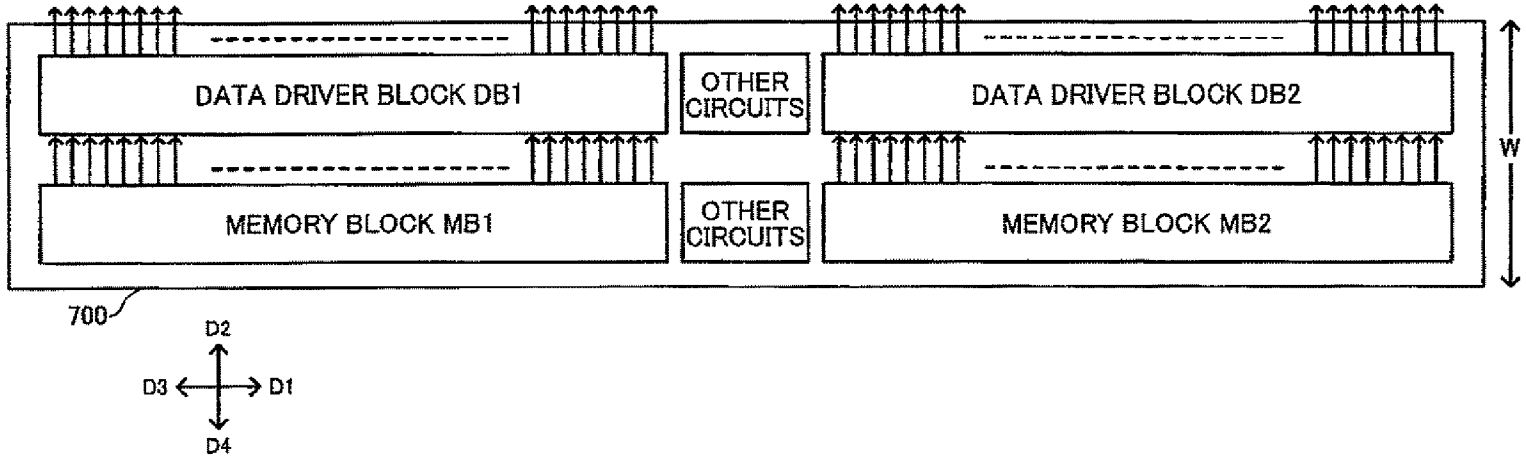
FIGS. 7A and 7B are views illustrative of integrated circuit devices according to comparative examples.
Figure 7B:
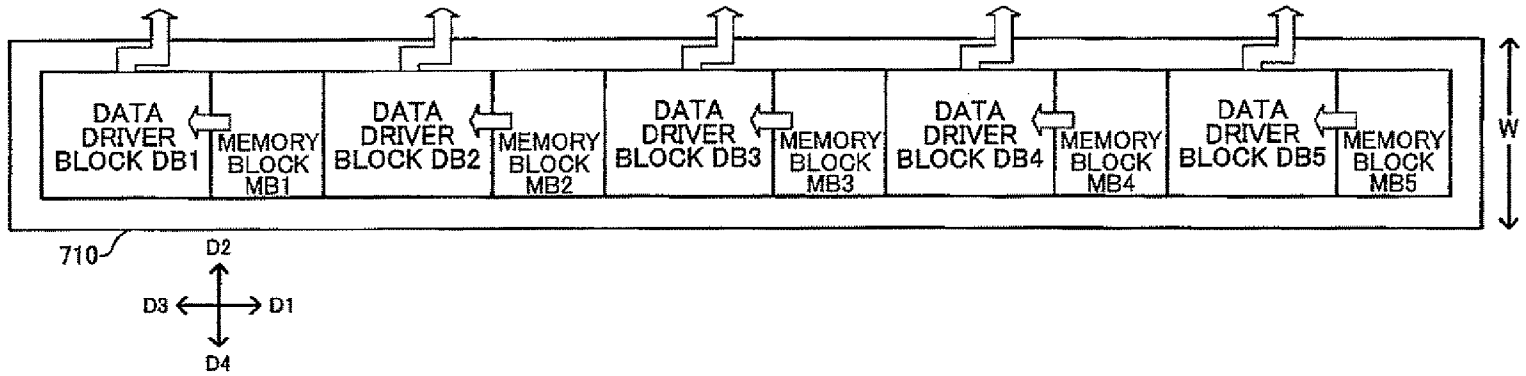

FIGS. 7A and 7B show integrated circuit devices according to comparative examples of this embodiment. In an integrated circuit device 700 shown in FIG. 7A, the data driver block DB1 is disposed in the direction D2 with respect to the memory block MB1, and the data driver block DB2 is disposed in the direction D2 with respect to the memory block MB2. Other circuits are disposed between the memory blocks MB1 and MB2 and between the data driver blocks DB1 and DB2.

In FIG. 7A, the image data is line-sequentially read from the memory blocks MB1. The image data (image data corresponding to one line) is simultaneously read from the memory block MB1 at a given timing, and output to the data driver block DB1. Likewise, the image data is line-sequentially read from the memory block MB2. The image data is simultaneously read from the memory block MB2 at a given timing, and output to the data driver block DB2. Therefore, the memory block MB1 and the data driver block DB1 are connected via signal lines in the same number as the number of the corresponding data lines (e.g., half of the data lines of the electro-optical panel), and the memory block MB2 and the data driver block DB2 are connected via signal lines in the same number as the number of the corresponding data lines. Specifically, since the number of signal lines is very large, the degree of freedom relating to the layout of the memory blocks MB1 and MB2 and the data driver blocks DB1 and DB2 decreases. For example, when the memory block MB1 and the data driver block DB1 are disposed so that the center position of the memory block MB1 does not coincide with the center position of the data driver block DB1 in the direction D1, the width W of the integrated circuit device 700 in the direction D2 increases to a large extent due to the wiring area of the signal lines that connect the memory block MB1 and the data driver block DB1. This makes it difficult to reduce the width W to implement a narrow chip. In particular, it is difficult to deal with an increase in the number of the data lines of the electro-optical panel aimed to increase the degree of definition.

In an integrated circuit device 710 shown in FIG. 7B (JP-A-2007-243125), the memory block MB1 and the data driver block DB1 are disposed adjacently along the direction D1. This also applies to the layout of the memory blocks MB2 to MB5 and the data driver blocks DB2 to DB5.

The integrated circuit device 710 shown in FIG. 7B has an advantage over the integrated circuit device 700 shown in FIG. 7A in that the degree of freedom relating to the layout can be increased so that the width W of the integrated circuit device in the direction D2 can be reduced.

However, since the signal lines from each memory block to each data driver block are provided along the direction D1 (D3) in FIG. 7B, the layout area of each data driver block increases due to the signal lines and the like. Moreover, it is necessary to rearrange the lines that connect the output signal lines of each data driver block to the data signal pads. Therefore, the width W of the integrated circuit device in the direction D2 cannot be reduced to a large extent due to rearrangement of the lines.

In FIG. 6, the image data is dot-sequentially read from each memory block. Therefore, the number of lines of the data transfer bus (TB1 to TB6) that connects each memory block and each data driver block is k (i.e., the number of lines of the data transfer bus is significantly smaller than the number of signal lines that connect each memory block and each data driver block in FIG. 7A). Therefore, the degree of freedom relating to the layout is higher than that of FIG. 7A.

In FIG. 6, the Jth memory block among the plurality of memory blocks and the Jth data driver block among the plurality of data driver blocks can be disposed so that the center position of the Jth memory block does not coincide with the center position of the Jth data driver block in the direction D1, for example. Therefore, other circuits other than the memory blocks and the data driver blocks, pads (terminals in a broad sense), and the like can be disposed in the space formed by the above-mentioned layout (i.e., the center position of the Jth memory block does not coincide with the center position of the Jth data driver block in the direction D1) so that the layout efficiency can be improved.

For example, a space can be formed in the direction D1 with respect to the memory block MB6 (Nth memory block) and in the direction D4 with respect to the data driver block DB6 (Nth data driver block) by disposing the memory blocks MB1 to MB6 and the data driver blocks DB1 to DB6 as shown in FIG. 6. Therefore, other circuits such as a grayscale voltage generation circuit and a logic circuit can be disposed in the resulting space.

Moreover, a space can be formed in the direction D2 with respect to the memory block MB1 (first memory block) and in the direction D3 with respect to the data driver block DB1

(first data driver block) by disposing the memory blocks MB1 to MB6 and the data driver blocks DB1 to DB6 as shown in FIG. 6. Therefore, a plurality of scan signal pads used to supply a scan signal to a plurality of scan lines of the electro-optical panel 400 (electro-optical device) can be disposed in the resulting space, for example. Therefore, the layout efficiency can be improved by effectively utilizing the space.

In FIG. 6, the number k of lines of the data transfer bus TB3 provided between the memory block MB3 and the data driver block DB3 is as small as eight or sixteen (k=8 or 16), and the number k of lines of the data transfer bus TB4 provided between the memory block MB4 and the data driver block DB4 is as small as eight or sixteen (k=8 or 16), for example. Therefore, a space can be formed between the memory blocks MB3 and MB4 by disposing the memory block MB3 at a position shifted in the direction D3 and disposing the memory block MB4 at a position shifted in the direction D1, for example. Therefore, other circuits such as a power supply circuit PB can be disposed in the resulting space. The impedance of the analog reference power supply voltage AGND that is output from an AGND output circuit of the power supply circuit PB and supplied to the data driver DR can be made uniform by thus disposing the power supply circuit PB. This prevents a deterioration in display characteristics so that the layout efficiency and the display characteristics can be improved.

In the comparative example shown in FIG. 7B, it is necessary to provide a number of signal lines in each data driver block from each memory block. In FIG. 6, it is unnecessary to provide such signal lines. Therefore, the area of each data driver block can be significantly reduced as compared with FIG. 7B. As a result, the width W the integrated circuit device 10 in the direction D2 can be reduced so that a narrow chip can be implemented while reducing the chip area. In FIG. 7B, it is necessary to rearrange the output signal lines from each data driver block. In FIG. 6, it is unnecessary to rearrange the output signal lines. Therefore, an increase in the width W the integrated circuit device 10 due to the rearrangement area can be prevented so that the width of the integrated circuit device 10 can be further reduced.

Figure 8:
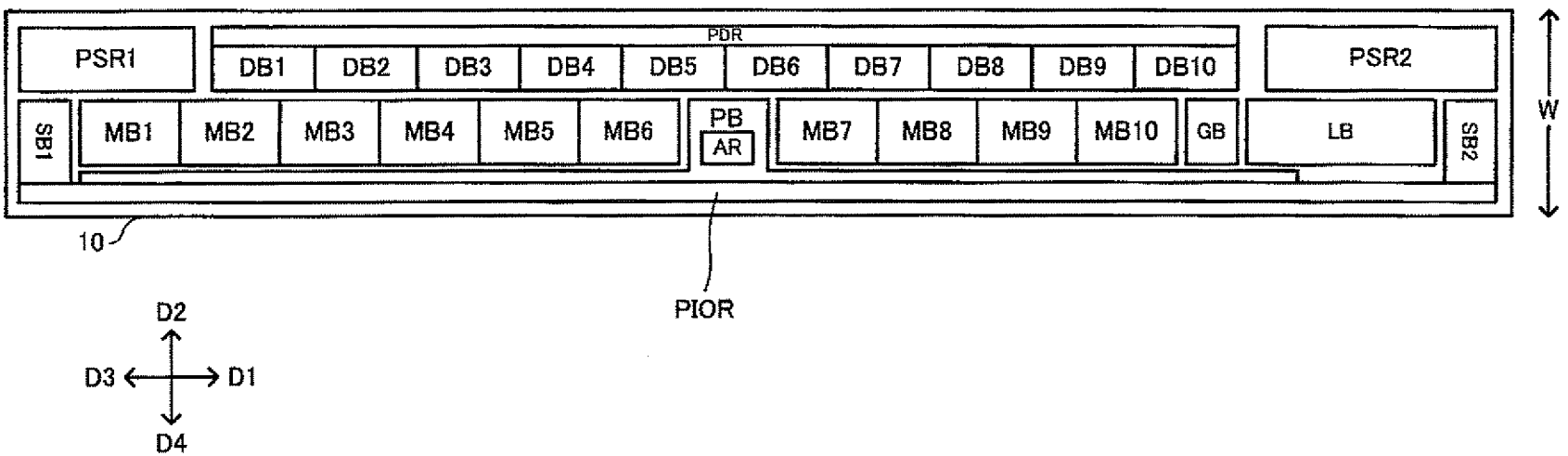
FIG. 8 shows a detailed layout example of an integrated circuit device.

FIG. 8 shows a detailed layout example of the integrated circuit device 10 according to this embodiment. Note that the layout shown in FIG. 8 is only an example. The layout according to this embodiment is not limited to FIG. 8.

In FIG. 8, memory blocks MB1 to MB10 (first to Nth memory blocks) are disposed along the direction D1. Data driver blocks DB1 to DB10 are disposed along the direction D1 in the direction D2 with respect to the memory blocks MB1 to MB10. Each of the memory blocks MB1 to MB10 and the corresponding data driver block among the data driver blocks DB1 to DB10 are disposed so that the center position of the memory block is shifted in the direction D1 with respect to the center position of the data driver block. Specifically, the right end of each of the memory blocks MB1 to MB10 does not coincide with the right end of each of the data driver blocks DB1 to DB10 in the direction D1, and the left end of each of the memory blocks MB1 to MB10 does not coincide with the left end of each of the data driver blocks DB1 to DB10 in the direction D1.

A grayscale voltage generation circuit GB generates a plurality of grayscale voltages, and supplies the grayscale voltages to the data driver blocks DB1 to DB10. Grayscale voltage signal lines are provided over the memory blocks MB1 to MB10 for example. In FIG. 8, the grayscale voltage generation circuit GB is disposed in the direction D1 with respect to the rightmost memory block MB10 (Nth memory block) and is disposed in the direction D4 with respect to the rightmost data driver block DB10 (Nth data driver block). According to this layout, the grayscale voltage generation circuit GB can be disposed by effectively utilizing such a space.

A scan driver SB1 disposed on the left end of the integrated circuit device 10 generates scan signals. The scan signal is supplied to the scan line of the electro-optical panel 400 through a scan signal pad disposed in a scan signal pad area PSR1. A scan driver SB2 disposed on the right end of the integrated circuit device 10 generates a scan signal. The scan signal is supplied to the scan line of the electro-optical panel 400 through a scan signal pad disposed in a scan signal pad area PSR2.

In FIG. 8, a plurality of scan signal pads (area PSR1) used to supply the scan signal to the scan line are disposed in the direction D2 with respect to the leftmost memory block MB1 (first memory block) and are disposed in the direction D3 with respect to the leftmost data driver block DB1 (first data driver block) According to this layout, a number of scan signal pads can be disposed in the area PSR1 by effectively utilizing such a space.

In FIG. 8, an AGND output circuit AR is disposed between the memory block MB6 (Mth memory block) and the memory block MB7 ((M+1)th memory block). An AGND line from the AGND output circuit AR is provided along the direction D1 over the data driver blocks DB1 to DB10. Therefore, the impedance of the AGND line can be made uniform.

In FIG. 8, a data signal pad arrangement area PDR (first interface area; output-side I/O area) is provided in the direction D2 with respect to the data driver blocks DB1 to DB10. A logic circuit LB pad (I/O pad), a voltage-booster pad connected to a voltage-booster capacitor for the power supply circuit PB, and a power supply pad connected to a power supply stabilization capacitor are disposed in a pad area PIOR (second interface area; input-side I/O area) provided in the direction D4 with respect to the memory blocks MB1 to MB10. A voltage-booster transistor (voltage booster circuit) of the power supply circuit PB is disposed in a narrow area between the memory blocks MB1 to MB10 and the pad area PIOR. Therefore, the drain of the voltage-booster transistor can be connected to the voltage-booster pad along a short path, for example.

5. Details of Data Transfer

Figure 9:
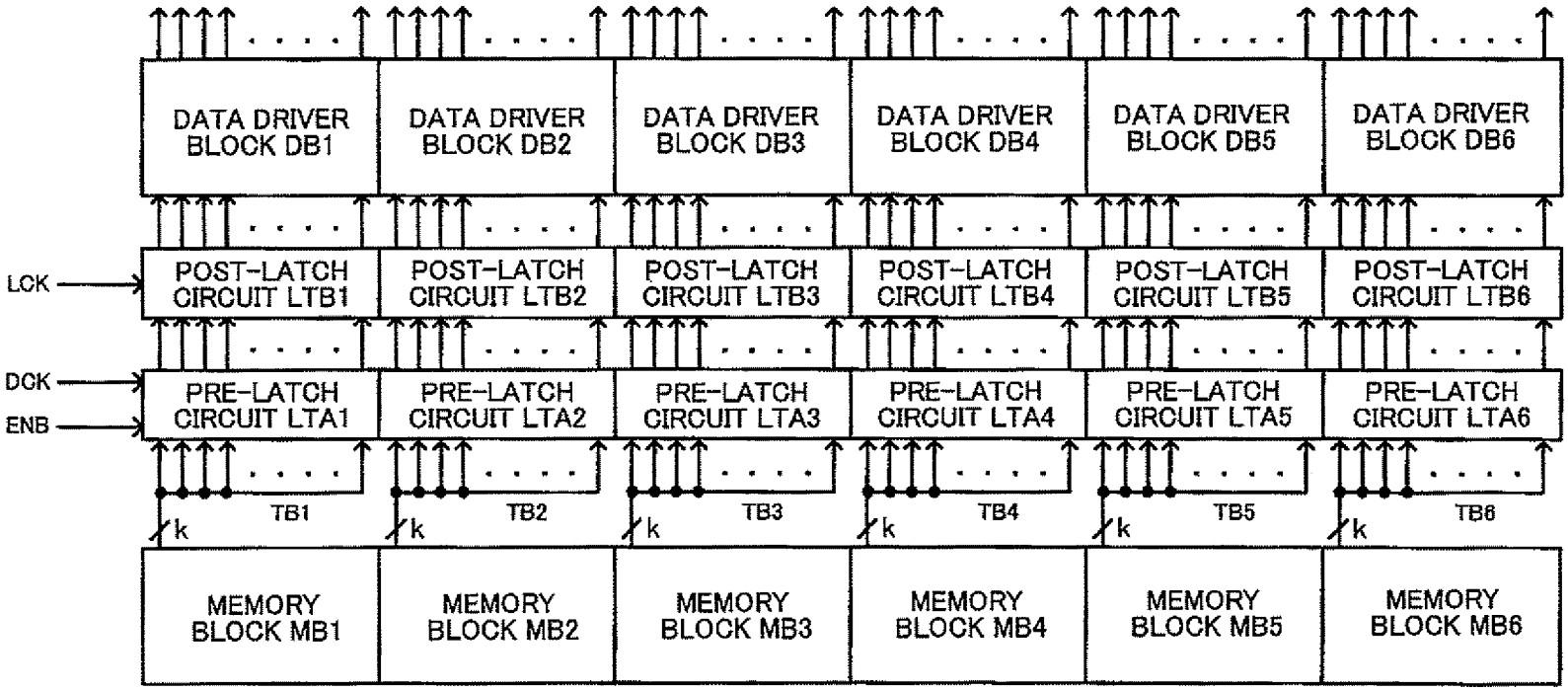
FIG. 9 is a view illustrative of data transfer between a data driver block and a memory block.

The details of data transfer between the data driver block and the memory block are described below. In FIG. 9, a latch circuit is provided between the memory blocks MB1 to MB6 (first to Nth memory blocks) and the data driver blocks DB1 to DB6 (first to Nth memory blocks). Specifically, pre-latch circuits LTA1 to LTA6 (first to Nth pre-latch circuits in a broad sense) and post-latch circuits LTB1 to LTB6 (first to Nth post-latch circuits in a broad sense) are provided.

The pre-latch circuit LTA1 (Jth pre-latch circuit in a broad sense) among the pre-latch circuits LTA1 to LTA6 (latch circuits in the preceding stage) sequentially latches the subpixel image data output from the memory block MB1 (Jth memory block) by time division. Specifically, the pre-latch circuit LTA1 sequentially latches the k-bit subpixel image data from a left flip-flop circuit to a right flip-flop circuit among a plurality of k-bit flip-flop circuits (registers) included in the pre-latch circuit LTA1 using a clock signal DCK. Specifically, the pre-latch circuit LTA1 sequentially latches the k-bit subpixel image data by the flip-flop circuits that are latch-enabled based on an enable signal ENB. When each piece of R data, G data, and B data contained in the subpixel image data is 8-bit data, k=8 when the image data corresponding to one subpixel is transferred, and k=16 when the image data corresponding to two subpixels is transferred.

The post-latch circuit LTB1 (Jth post-latch circuit in a broad sense) among the post-latch circuits LTB1 to LTB6 (latch circuits in the subsequent stage) line-sequentially reads and latches the subpixel image data from the pre-latch circuit LTA1 (Jth pre-latch circuit) after the pre-latch circuit LTA1 has latched the subpixel image data. The post-latch circuit LTB1 outputs the latched subpixel image data to the data driver block DB1 (Jth data driver block). Specifically, the post-latch circuit LTB1 simultaneously reads and latches the entire subpixel image data latched by the pre-latch circuit LTA1 using a latch clock signal LCK. The post-latch circuit LTB1 outputs the latched subpixel image data to the data driver block DB1.

The pre-latch circuit LTA2 sequentially latches the subpixel image data output from the memory block MB2 by time division. The post-latch circuit LTB2 line-sequentially reads and latches the subpixel image data from the pre-latch circuit LTA2 after the pre-latch circuit LTA2 has latched the subpixel image data. The post-latch circuit LTB2 outputs the latched subpixel image data to the data driver block DB2. The operations of the pre-latch circuits LTA3 to LTA6 and the post-latch circuits LTB3 to LTB6 are the same as described above. The latch operations of the pre-latch circuits LTA1 to LTA6 are performed in parallel at the same timing, and the latch operations of the post-latch circuits LTB1 to LTB6 are performed in parallel at the same timing.

Figure 10:
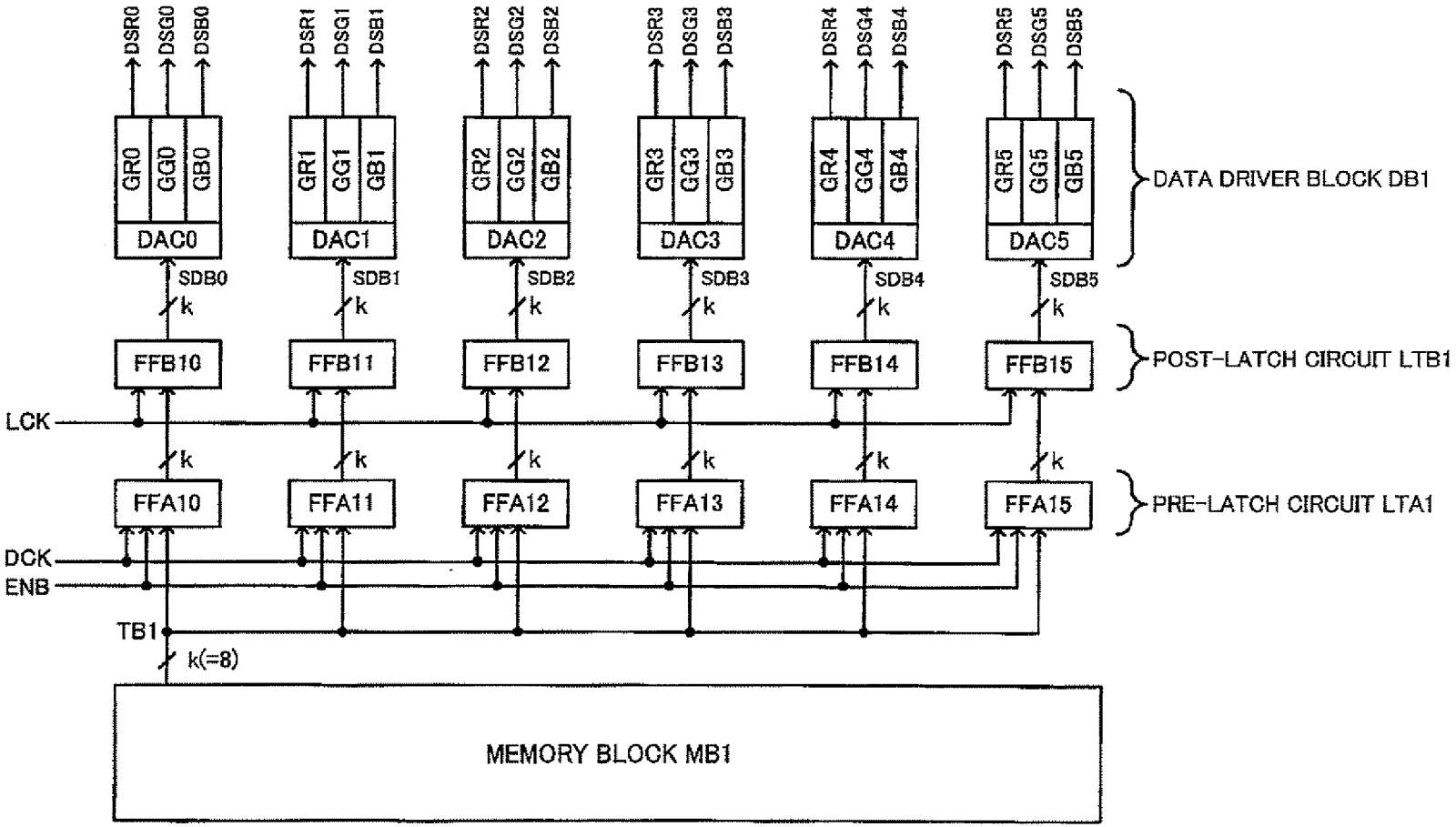
FIG. 10 shows a configuration example of a pre-latch circuit, a post-latch circuit, and a data driver block.

FIG. 10 shows a detailed configuration example of the pre-latch circuit LTA1, the post-latch circuit LTB1, and the data driver block DB1. The detailed configuration of the pre-latch circuits LTA2 to LTA6, the post-latch circuits LTB2 to LTB6, and the data driver blocks DB2 to DB6 is the same as that shown in FIG. 10. Therefore, description thereof is omitted.

The pre-latch circuit LTA1 (Jth pre-latch circuit) includes a plurality of flip-flop circuits FFA10 to FFA15. Each of the flip-flop circuits FFA10 to FFA15 is a circuit (register) that can hold the k-bit (=8-bit) subpixel image data.

The post-latch circuit LTB1 (Jth post-latch circuit) includes a plurality of flip-flop circuits FFB10 to FFB15. Each of the flip-flop circuits FFB10 to FFB15 is a circuit (register) that can hold the k-bit (=8-bit) subpixel image data.

The data driver block DB1 (Jth data driver block) includes a plurality of sub-driver blocks SDB0 to SDB5. Each of the sub-driver blocks SDB0 to SDB5 outputs the data signal corresponding to at least one pixel based on the subpixel image data output from the memory block MB1 (Jth memory block). For example, the sub-driver block SDB0 outputs the R, G, and B data signals DSR0, DSG0, and DSB0 corresponding to one pixel based on the subpixel image data. Likewise, the sub-driver block SDB1 outputs the R, G, and B data signals DSR1, DSG1, and DSB1 corresponding to one pixel. The above description also applies to the sub-driver blocks SDB2 to SDB5.

In FIG. 10, each of the sub-driver blocks SDB0 to SDB5 includes a D/A conversion circuit and a plurality of data line driver circuits (subpixel driver cells or grayscale amplifiers) that share the D/A conversion circuit.

For example, the sub-driver block SDB0 includes the D/A conversion circuit DAC0 and the data line driver circuits GR0, GG0, and GB0 that share the D/A conversion circuit DAC0 by time division. The data line driver circuits GR0, GG0, and GB0 are R, G, and B data line driver circuits, respectively. The data line driver circuits GR0, GG0, and GB0 output the R, G, and B data signals DSR0, DSG0, and DSB0, respectively.

The sub-driver block SDB1 includes the D/A conversion circuit DAC1 and the data line driver circuits GR1, GG1, and GB1 that share the D/A conversion circuit DAC1 by time division. The data line driver circuits GR1, GG1, and GB1 are R, G, and B data line driver circuits, respectively. The data line driver circuits GR1, GG1, and GB1 output the R, G, and B data signals DSR1, DSG1, and DSB1, respectively. The above description also applies to the sub-driver blocks (cells) SDB2 to SDB5. The data signals DSR1, DSG1, and DSB1 are data signals corresponding to a pixel adjacent to the pixel corresponding to the data signals DSR0, DSG0, and DSB0, and the data signals DSR2, DSG2, and DSB2 are data signals corresponding to a pixel adjacent to the pixel corresponding to the data signals DSR1, DSG1, and DSB1.

The operations of the circuits shown in FIG. 10 are described below using a signal waveform example shown in FIG. 11. As indicated by F1 in FIG. 11, the memory block MB1 dot-sequentially reads the k-bit (=8-bit) subpixel image data R0 to R5, and outputs the subpixel image data R0 to R5 by time division. As indicated by F2, the pre-latch circuit LTA1 (Jth pre-latch circuit) sequentially latches the R (first color component in a broad sense) subpixel image data R0 to R5 output from the memory block MB1 (Jth memory block) by time division. Specifically, when the enable signal ENB indicates "0" (F3), the flip-flop circuit FFA10 shown in FIG. 10 latches the subpixel image data R0 using the clock signal DCK. When the enable signal ENB indicates "1" (F4), the flip-flop circuit FFA11 adjacent to the flip-flop circuit FFA10 latches the subpixel image data R1 using the clock signal DCK. Likewise, when the enable signal ENB indicates "2", "3", "4", or "5", the flip-flop circuit FFA12, FFA13, FEA14, or FFA15 respectively latches the subpixel image data R2, R3, R4, or R5 using the clock signal DCK.

After the pre-latch circuit LTA1 has latched the R (first color component) subpixel image data R0 to R5 (F5), the post-latch circuit LTB1 (Jth post-latch circuit) line-sequentially reads and latches the subpixel image data R0 to R5 from the pre-latch circuit LTA1 (F6). Specifically, the flip-flop circuits FFB11 to FFB15 of the post-latch circuit LTB1 simultaneously latch the subpixel image data R0 to R5 latched by the flip-flop circuits FFA10 to FFA15 of the pre-latch circuit LTA1 using the latch clock signal LCK.

When the post-latch circuit LTB1 has latched the R subpixel image data R0 to R5 (F7), the data driver block DB1 (Jth data driver block) samples the signal (voltage) corresponding to the latched subpixel image data R0 to R5 (F8). The data driver block DB1 then holds the sampled voltage (F9). Specifically, the D/A conversion circuits DAC0 to DAC5 of the sub-driver blocks SDB0 to SDB5 is respectively D/A-convert the subpixel image data R0 to R5. Each of the R data line driver circuits GR0 to GR5 (sample-hold circuits) of the sub-driver blocks SDB0 to SDB5 then samples and holds the voltage obtained by D/A conversion.

The pre-latch circuit LTA1 then sequentially latches the G (second color component in a broad sense) subpixel image data G0 to G5 output from the memory block MB1 by time division (F10).

After the pre-latch circuit LTA1 has latched the subpixel image data G0 to G5 (F11), the post-latch circuit LTB1 line-sequentially reads and latches the latched subpixel image data G0 to G5 from the pre-latch circuit LTA1 (F12).

When the post-latch circuit LTB1 has latched the subpixel image data G0 to G5 (F13), the data driver block DB1 samples the signal (voltage) corresponding to the latched subpixel image data G0 to G5 (F14). The data driver block DB1 then holds the sampled voltage (F15).

The pre-latch circuit LTA1 then sequentially latches the B (third color component in a broad sense) subpixel image data B0 to B5 output from the memory block MB1 by time division (F16).

After the pre-latch circuit LTA1 has latched the subpixel image data B0 to B5 (F17), the post-latch circuit LTB1 line-sequentially reads and latches the latched subpixel image data B0 to B5 from the pre-latch circuit LTA1 (F18).

When the post-latch circuit LTB1 has latched the subpixel image data B0 to B5 (F19), the data driver block DB1 samples the signal (voltage) corresponding to the latched subpixel image data B0 to B5 (F20). The data driver block DB1 then holds the sampled voltage (F21).

Figure 11:
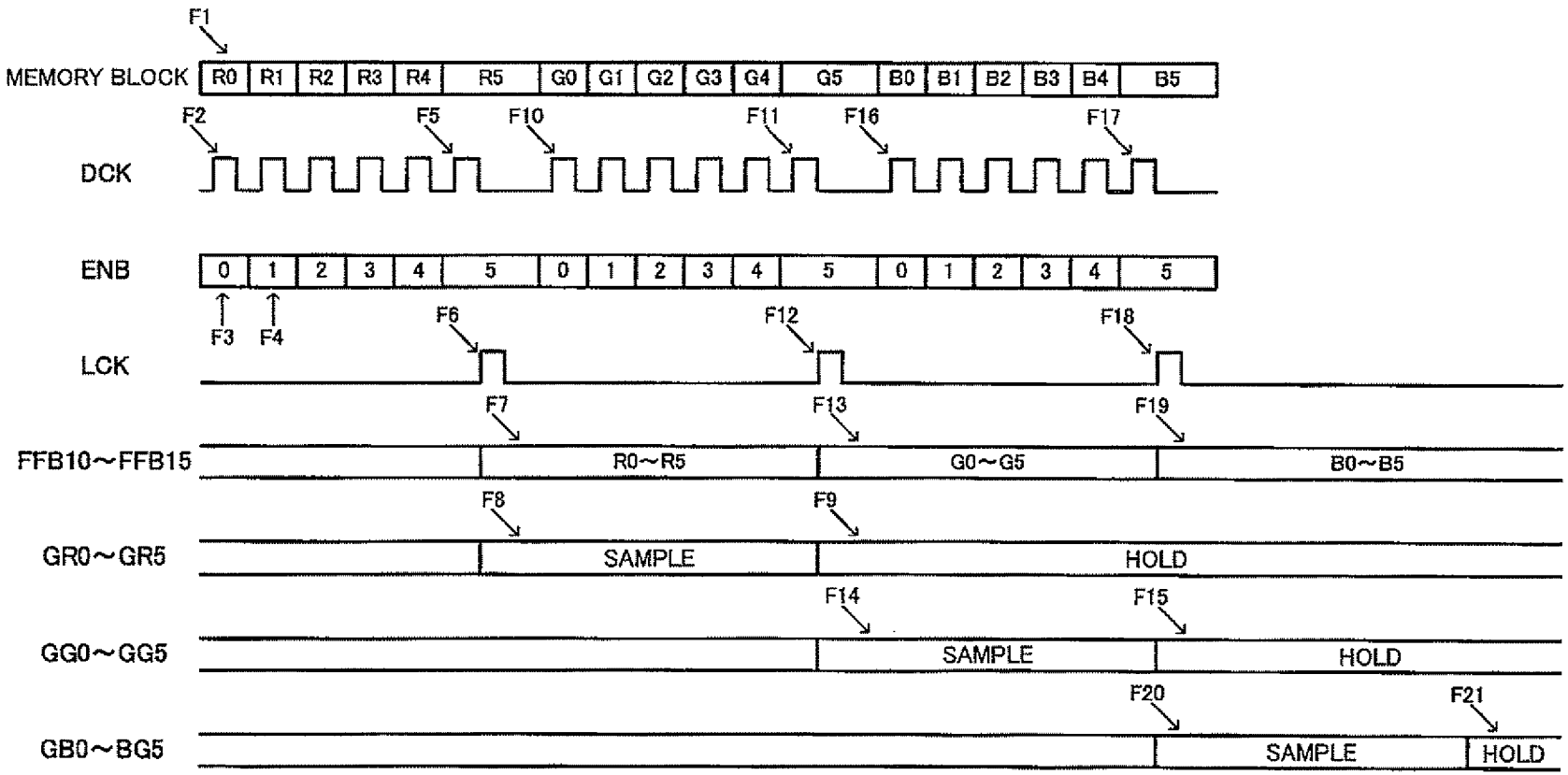
FIG. 11 shows a signal wave-form example illustrative of the operation of circuits shown in FIG. 10.

According to the method shown in FIG. 11, the R subpixel image data, the G subpixel image data, and the B subpixel image data can be sequentially latched in the order of R, G, and B, and input to the data driver block DB1. The data driver block DB1 samples and holds the signals (voltages) corresponding to the R, G, and B subpixel image data.

Therefore, when the R, G, and B grayscale characteristics differ from one another, gamma correction corresponding to R, G, and B cam be independently implemented by causing the grayscale voltage generation circuit 110 shown in FIG. 2B to output the R, G, and B grayscale voltages by time division. As a result, the display quality can be improved.

Figure 12:
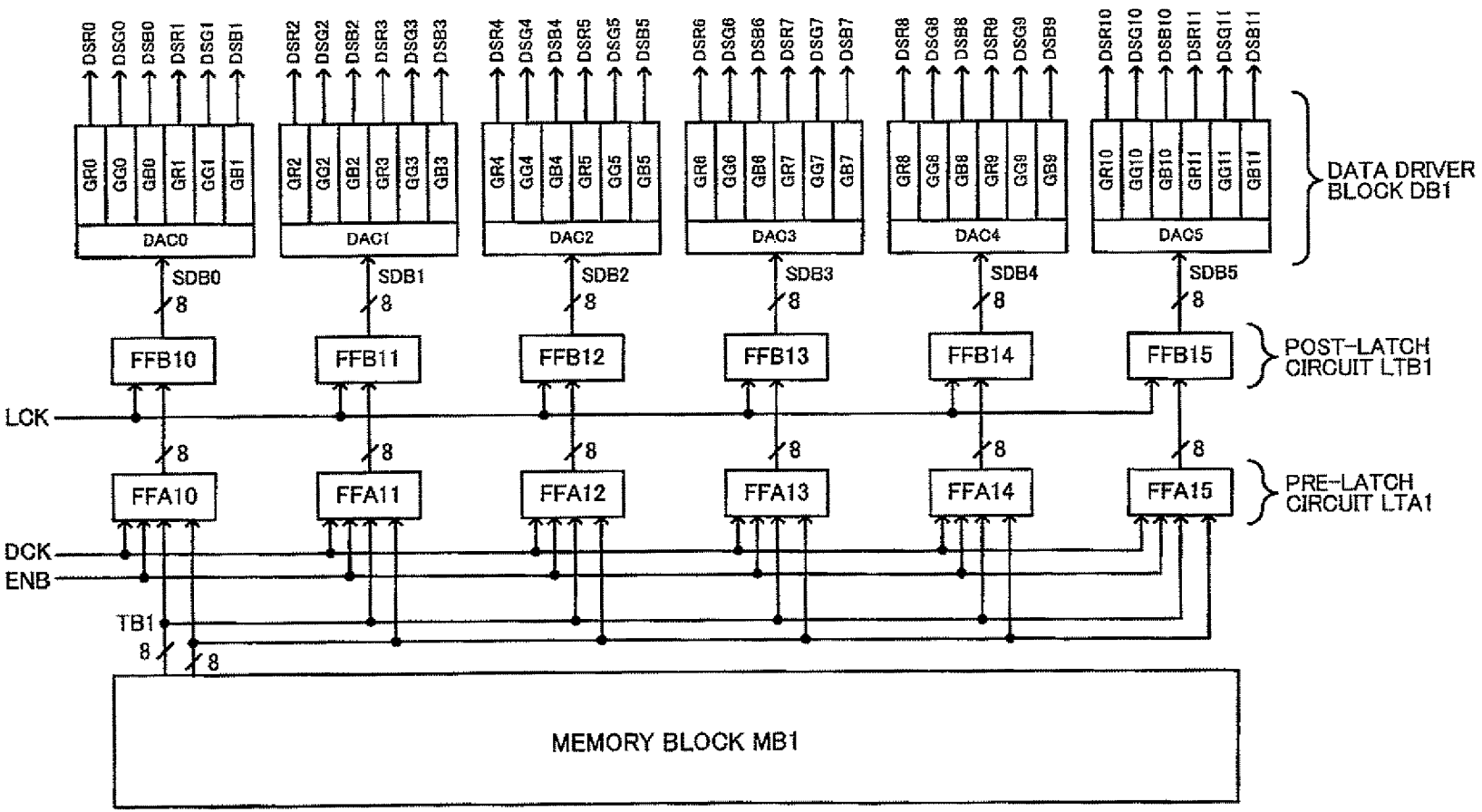
FIG. 12 shows another configuration example of a pre-latch circuit, a post-latch circuit, and a data driver block.

The above description has been given taking an example in which each memory block outputs the image data corresponding to one subpixel by time division (dot-sequentially). Note that the invention is not limited thereto. Each memory block may output the image data corresponding to a plurality of subpixels by time division. FIG. 12 shows a configuration example of the pre-latch circuit LTA1, the post-latch circuit LTB1, and the data driver block DB1 in this case. In FIG. 12, 16-bit (=k-bit) subpixel image data corresponding to two subpixels is output from the memory block MB1. The 16-bit subpixel image data is sequentially latched by the flip-flop circuits FFA10 to FFA15. The 16-bit subpixel image data is then latched by the flip-flop circuits FFB10 to FFB15 in the subsequent stage.

In FIG. 12, each of the sub-driver blocks SDB0 to SDB5 outputs the data signals corresponding to two pixels based on the subpixel image data output from the memory block MB1. Specifically, the sub-driver block SDB0 outputs R, G, and B data signals DSR0, DSG0, DSB0, DSR1, DSG1, and DSB1 corresponding to two pixels. Likewise, the sub-driver block SDB1 outputs R, G, and B data signals DSR2, DSG2, DSB2, DSR3, DSG3, and DSB3 corresponding to two pixels. The above description also applies to the sub-driver blocks SDB2 to SDB5.

According to this configuration, the speed of data transfer from the memory block to the pre-latch circuit can be increased. Therefore, the sample operation and the hold operation of the data driver block can be provided with a sufficient time margin.

6. Power Supply Circuit

Figure 13:
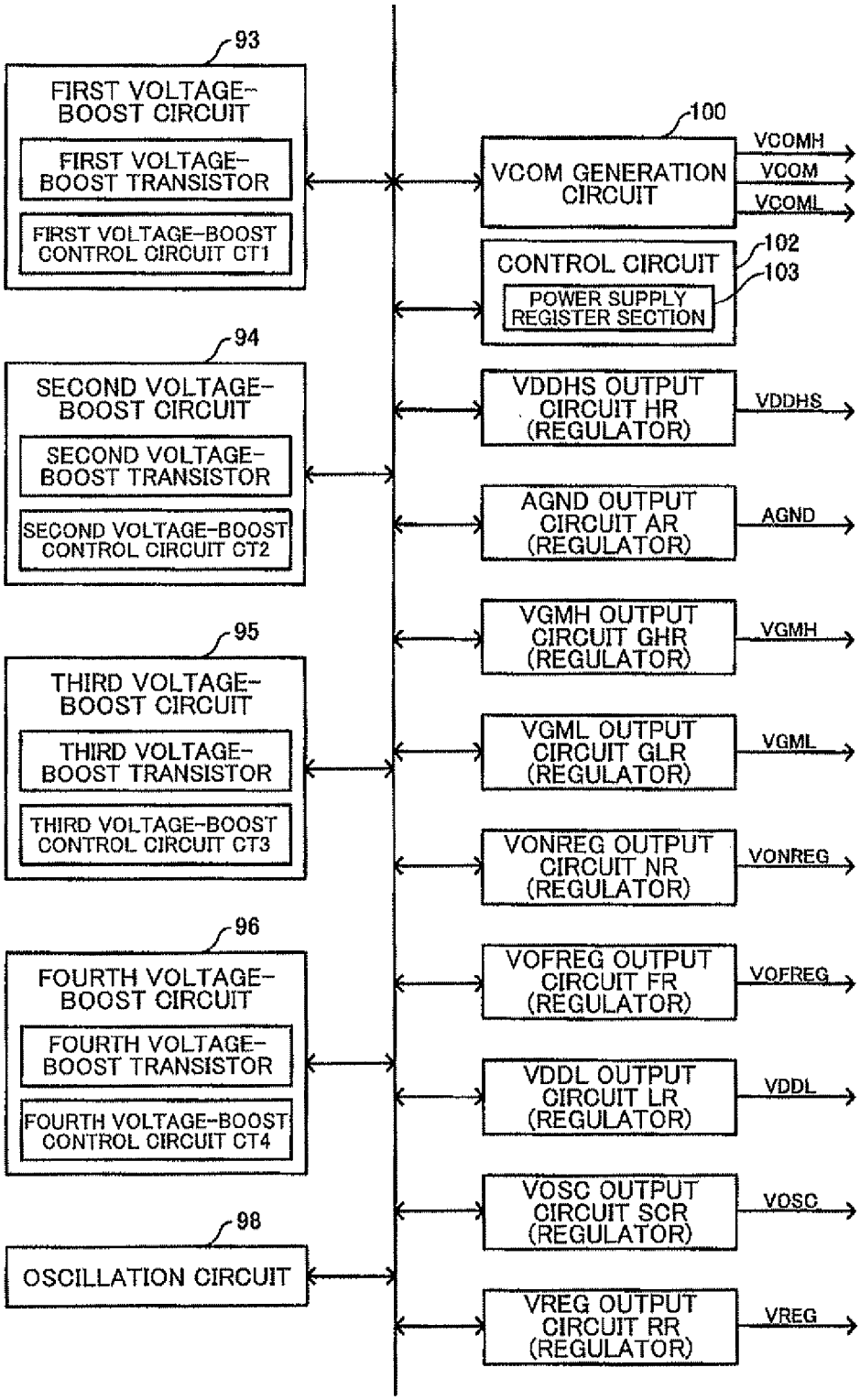
FIG. 13 shows a detailed configuration example of a power supply circuit.

FIG. 13 shows a configuration example of the power supply circuit (PB). Note that the power supply circuit is not limited to the configuration shown in FIG. 13. Various modification may be made such as omitting some of the elements or adding other elements.

The power supply circuit shown in FIG. 13 includes first to fourth voltage-boost circuits 93 to 96, a voltage-boost clock signal generation oscillation circuit 98, a VCOM generation circuit 100, a control circuit 102, VDDHS, AGND, VGMH, VGML, VONREG, VOFREG, VDDL, VOSC, and VREG output circuits HR, AR, GHR, GLR, NR, FR, LR, SCR, and RR. The first to fourth voltage-boost circuits 93 to 96 include first to fourth voltage-boost transistors and first to fourth voltage-boost control circuits CT1 to CT4, respectively. The first to fourth voltage-boost circuits 93 to 96 respectively perform first to fourth voltage-boost operations. The first to fourth voltage-boost control circuits CT1 to CT4 control the first to fourth voltage-boost circuits 93 to 96. The first to fourth voltage-boost control circuits CT1 to CT4 supply a voltage-boost clock signal to the first to fourth voltage-boost transistors, respectively. The VCOM generation circuit 100 generates and outputs VCOM voltages VCOMH, VCOML, and the like supplied to a common electrode of the electro-optical panel. The control circuit 102 controls the power supply circuit.

The control circuit 102 includes a power supply register section 103 (index register). The power supply register section 103 includes a plurality of registers. The power supply adjustment data that is set using the data signal from the logic circuit is written into a register specified by a register address of an address signal from the logic circuit (LB).

Figure 14:
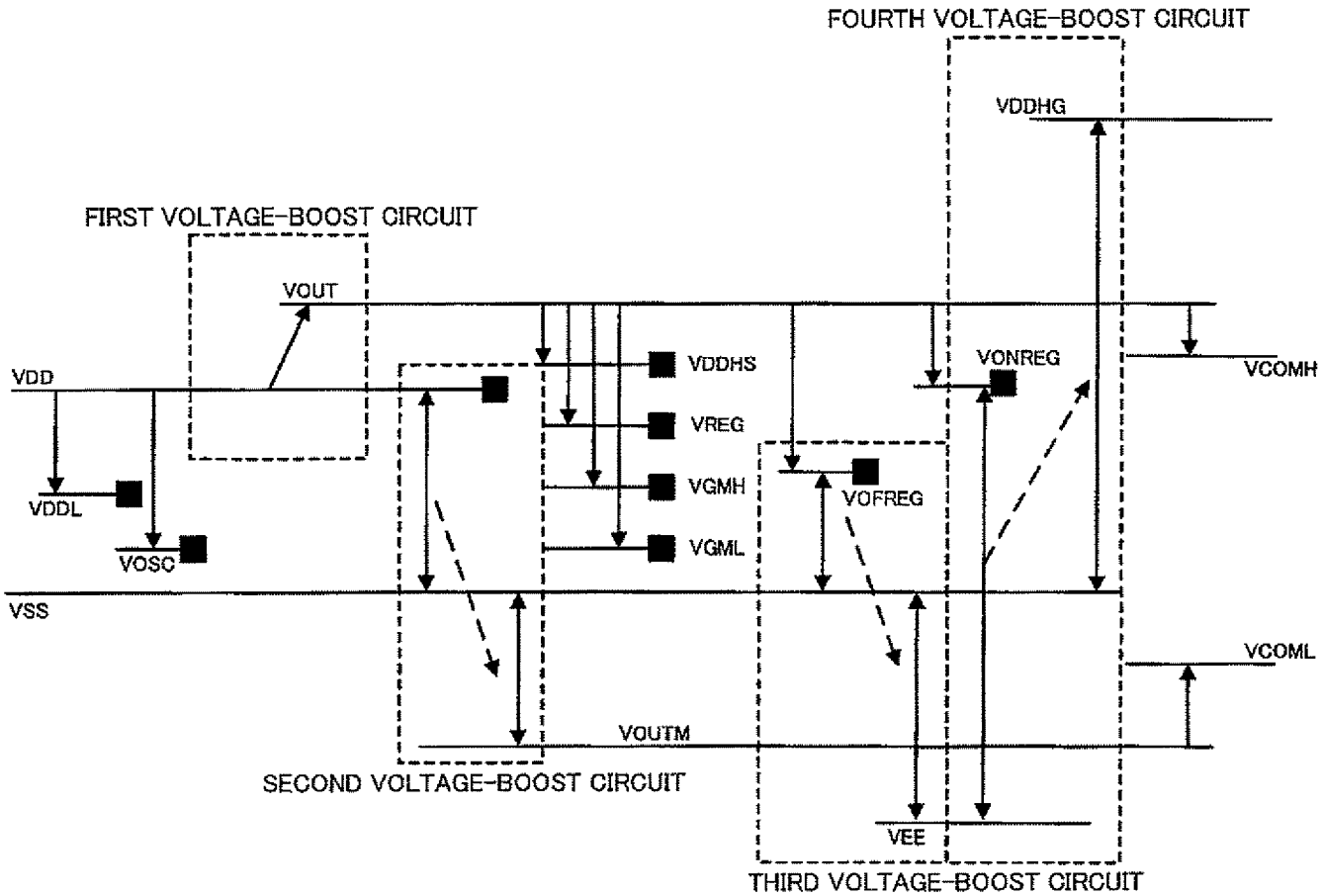
FIG. 14 is a potential relationship diagram illustrative of the operation of a power supply circuit.

The operation of the power supply circuit is described below using a potential relationship diagram shown in FIG. 14. The first voltage-boost circuit 93 boosts a voltage between the power supply voltages VDD and VSS in the positive direction to generate a power supply voltage VOUT (first boosted voltage). The second voltage-boost circuit 94 boosts a voltage between the power supply voltages VDD and VSS in the negative direction to generate a power supply voltage VOUTM (second boosted voltage). The third voltage-boost circuit 95 boosts a voltage between the power supply voltages VOFREG and VSS in the negative direction to generate a scan driver negative power supply voltage VEE (gate-off voltage). The fourth voltage-boost circuit 96 boosts a voltage between the power supply voltages VONREG and VEE in the positive direction to generate a scan driver power supply voltage VDDHG (gate-on voltage).

The output circuits (regulators) HR, GHR, GLR, NR, and FR shown in FIG. 13 adjust (decrease) the potential of the power supply voltage VOUT, and output the power supply voltages VDDHS, VGMH, VGML, VONREG, and VOFREG, respectively. The output circuits (regulators) LR and SCR adjust (decrease) the potential of the power supply voltage VDD, and output the power supply voltages VDDL and VOSC, respectively. The power supply voltage VDDHS refers to a high-potential-side power supply voltage of the data driver, and the power supply voltages VGMH and VGML respectively refer to the maximum grayscale voltage and the minimum grayscale voltage of the grayscale voltage generation circuit. The power supply voltages VONREG and VOFREG refer to VDDHG and VEE generation reference power supply voltages. The power supply voltage VDDL refers to an internal logic power supply voltage, and the power supply voltage VOSC refers to an oscillation power supply voltage.

Figure 15:
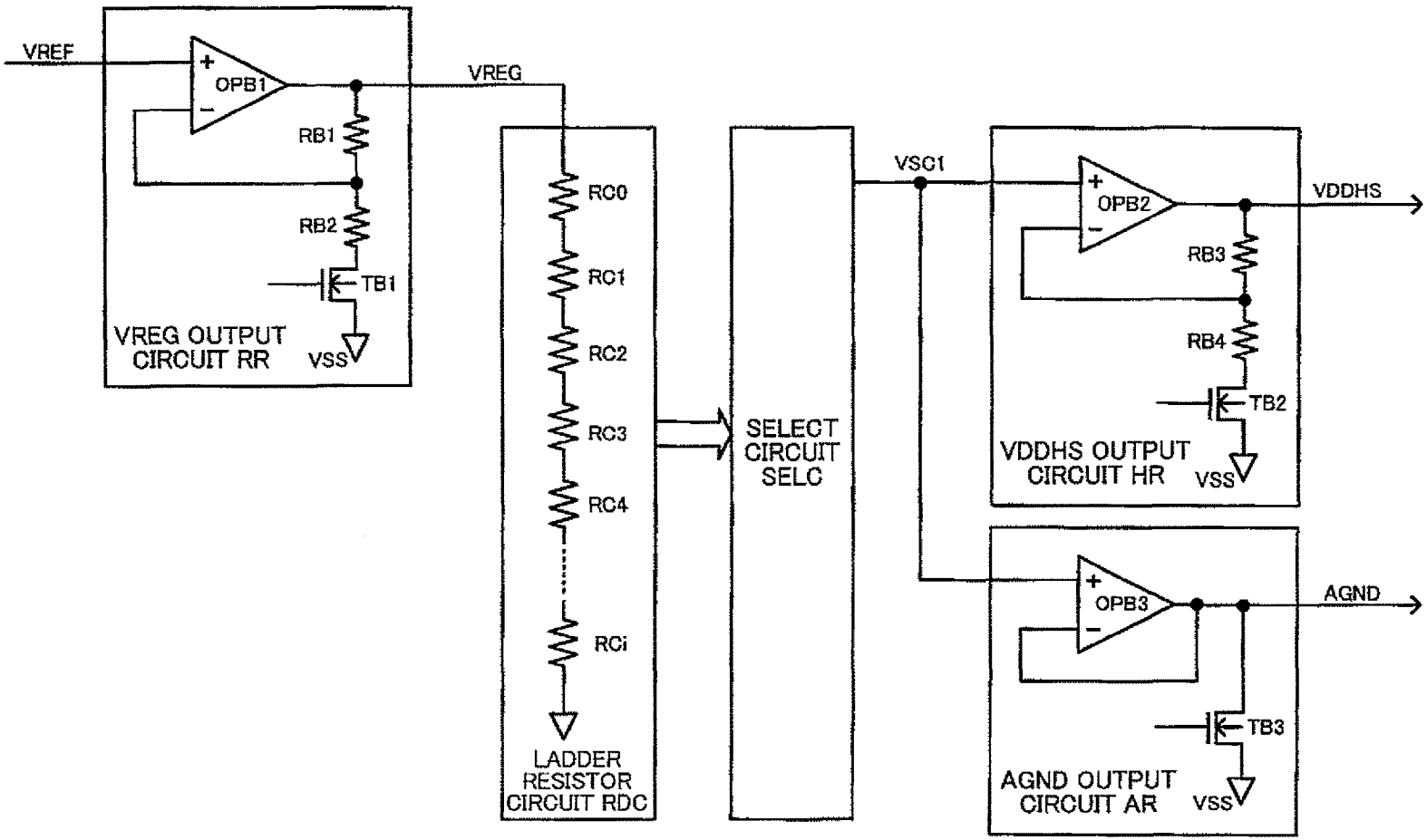
FIG. 15 is a view illustrative of an AGND generation method.

A specific method of generating the analog reference power supply voltage AGND is described below with reference to FIG. 15. As shown in FIG. 15, the power supply circuit further includes a ladder resistor circuit RDC and a select circuit SELC (not shown in FIG. 13).

The ladder resistor circuit RDC includes a plurality of resistors RC0 to RCi that are connected in series. The ladder resistor circuit RDC divides a reference power supply voltage VREG (i.e., a voltage between the power supply voltages VREG and VSS) using the resistors. A VREG output circuit RR that includes an operational amplifier OPB1 and resistors RB1 and RB2 generates the reference power supply voltage VREG based on a reference voltage VREF, and outputs the reference power supply voltage VREG. Note that a transistor TB1 is a display-off discharge transistor.

The select circuit SELC selects a divided voltage VSC1 among a plurality of divided voltages divided by the ladder resistor circuit RDC, and outputs the divided voltage VSC1 to the AGND output circuit AR. The select circuit SELC also outputs the divided voltage VSC1 to the VDDHS output circuit HR.

The AGND output circuit AR includes a voltage-follower-connected operational amplifier OPB3. The AGND output circuit AR subjects the divided voltage VSC1 to impedance conversion, and outputs the analog reference power supply voltage AGND at the same voltage as the divided voltage VSC1. The VDDHS output circuit HR includes an operational amplifier OPB2 and resistors RB3 and RB4. The VDDHS output circuit HR generates the power supply voltage VDDHS of the data driver based on the divided voltage VSC1, and outputs the power supply voltage VDDHS. Note that transistors TB2 and TB3 are display-off discharge transistors, In FIG. 15, if the resistances of the resistors RB3 and RB4 of the VDDHS output circuit HR are made equal, for example, the VDDHS output circuit HR adjusts the divided voltage VSC1, and outputs a voltage twice the divided voltage VSC1 as the power supply voltage VDDHS. Therefore, the analog reference power supply voltage AGND set at (VDDHS+VSS)/2 is output from the AGND output circuit AR.

7. Layout of Power Supply Circuit

Figure 16:
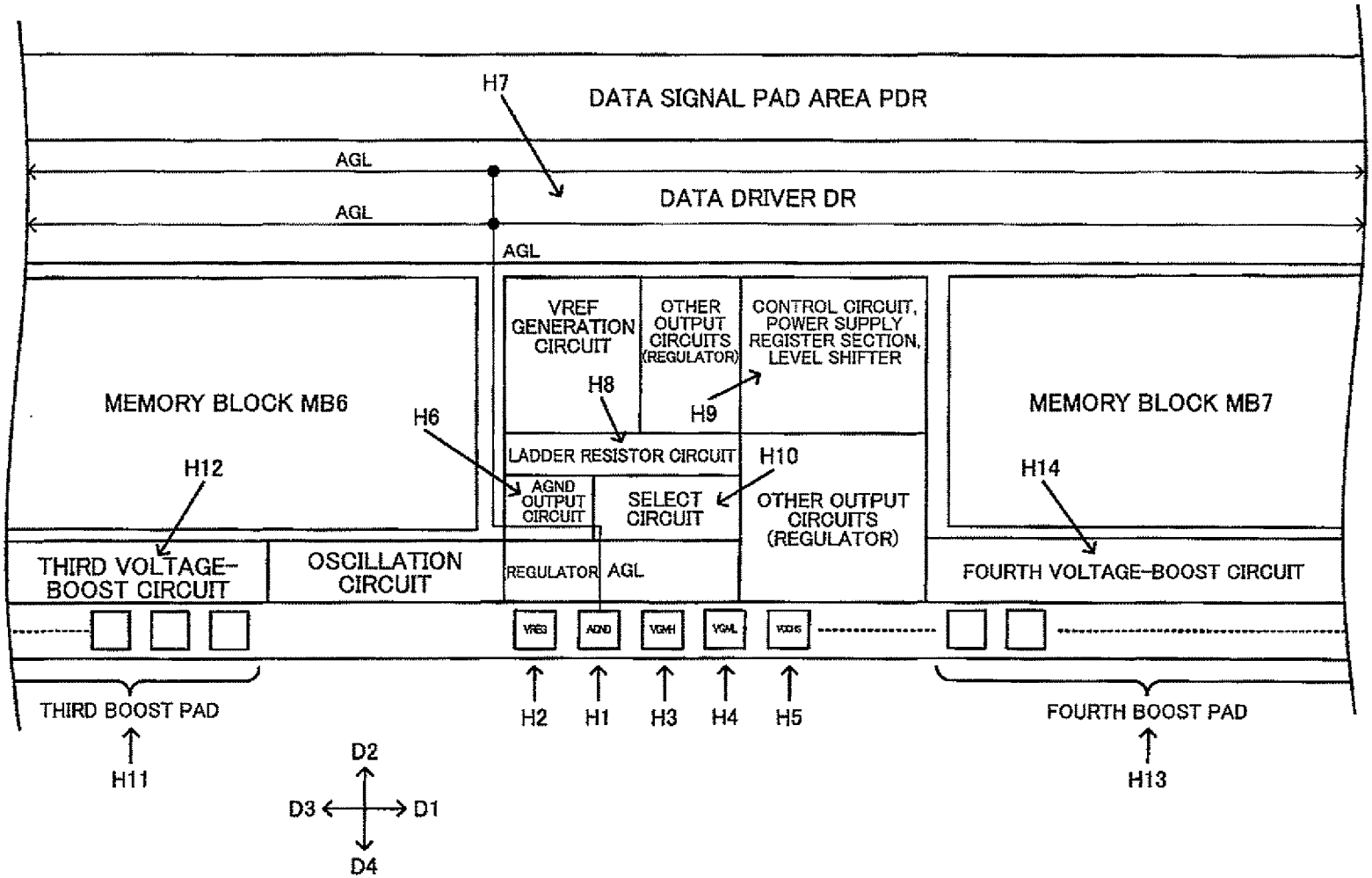
FIG. 16 shows a detailed layout example of a power supply circuit.

FIG. 16 shows a detailed layout example of the power supply circuit. An AGND stabilization capacitor (not shown) is connected to an AGND pad (analog reference power supply pad or analog reference power supply terminal) indicated by H1 in FIG. 16. A power supply voltage stabilization capacitor is connected to each of VREG, VGMH, VGML, and VDDHS pads indicated by H2, H3, H4, and H5. These stabilization capacitors are connected as external components. Specifically, these stabilization capacitors are mounted as external components on a circuit board (e.g., flexible board) on which an IC of the integrated circuit device 10 is mounted.

As indicated by H6 in FIG. 16, the AGND output circuit AR is disposed between the AGND pad (H1) and the data driver DR (H7).

Specifically, it is desirable to dispose the AGND output circuit AR near the data driver DR so that the impedance of the AGND line is made uniform. On the other hand, the AGND stabilization capacitor is necessary in order to suppress a change in the analog reference power supply voltage AGND, and it is desirable to reduce the impedance between the stabilization capacitor and the AGND output circuit AR.

In FIG. 16, the AGND output circuit AR is disposed between the AGND pad and the data driver DR, as indicated by H6, taking into consideration the balance between the uniformity of impedance and suppression of a change in the analog reference power supply voltage AGND. Therefore, since the AGND output circuit AR can be disposed near the AGND pad (H1), a change in voltage can be suppressed by the stabilization capacitor. Moreover, since the distance between the AGND output circuit AR and the data driver DR is not increased to a large extent, the impedance of the AGND line can be made uniform.

As indicated by H6 in FIG. 16, the AGND output circuit AR is disposed between the ladder resistor circuit RDC (H8) and the AGND pad (H1).

According to this layout, the power supply voltages can be adjusted using the ladder resistor circuit RDC and the select circuit SELC disposed at positions indicated by H8 and H10 based on the power supply adjustment data output from the power supply register section 103 disposed at a position indicated by H9, and the divided voltage VSC1 output from the select circuit SELC can be input to the AGND output circuit AR along a short path. Therefore, a change in the analog reference power supply voltage AGND can be suppressed by disposing the AGND output circuit AR near the AGND pad while improving the layout efficiency.

A third voltage-boost pad (Kth voltage-boost pad in a broad sense; K is a natural number) connected to a third voltage-boost capacitor (Kth voltage-boost capacitor in a broad sense) is disposed at a position indicated by H11 in FIG. 16. The third voltage-boost circuit (Kth voltage-boost circuit in a broad sense) is disposed at a position indicated by H12. Specifically, the third voltage-boost circuit is disposed between the third voltage-boost pad and the memory block MB6 (Mth memory block).

A fourth voltage-boost pad ((K+1)th voltage-boost pad in a broad sense) connected to a fourth voltage-boost capacitor ((K+1)th voltage-boost capacitor in a broad sense) is disposed at a position indicated by H13. The fourth voltage-boost circuit ((K+1)th voltage-boost circuit in a broad sense) is disposed at a position indicated by H14. Specifically, the fourth voltage-boost circuit is disposed between the fourth voltage-boost pad and the memory block MB7 ((M+1)th memory block).

As indicated by H1, the AGND pad is disposed between the third voltage-boost pad (H1) and the fourth voltage-boost pad (H13).

For example, the third voltage-boost capacitor and the fourth voltage-boost capacitor (not shown) are connected to the third voltage-boost pad and the fourth voltage-boost pad as external components. The stabilization capacitor is connected to the AGND pad (H1) as an external component. Therefore, the pads connected to the external capacitors can be disposed collectively by disposing the pads as indicated by H1, H11, H13, and the like. Therefore, the capacitors can be simply and efficiently mounted on the circuit board. This improves convenience to the user, for example.

Figure 17:
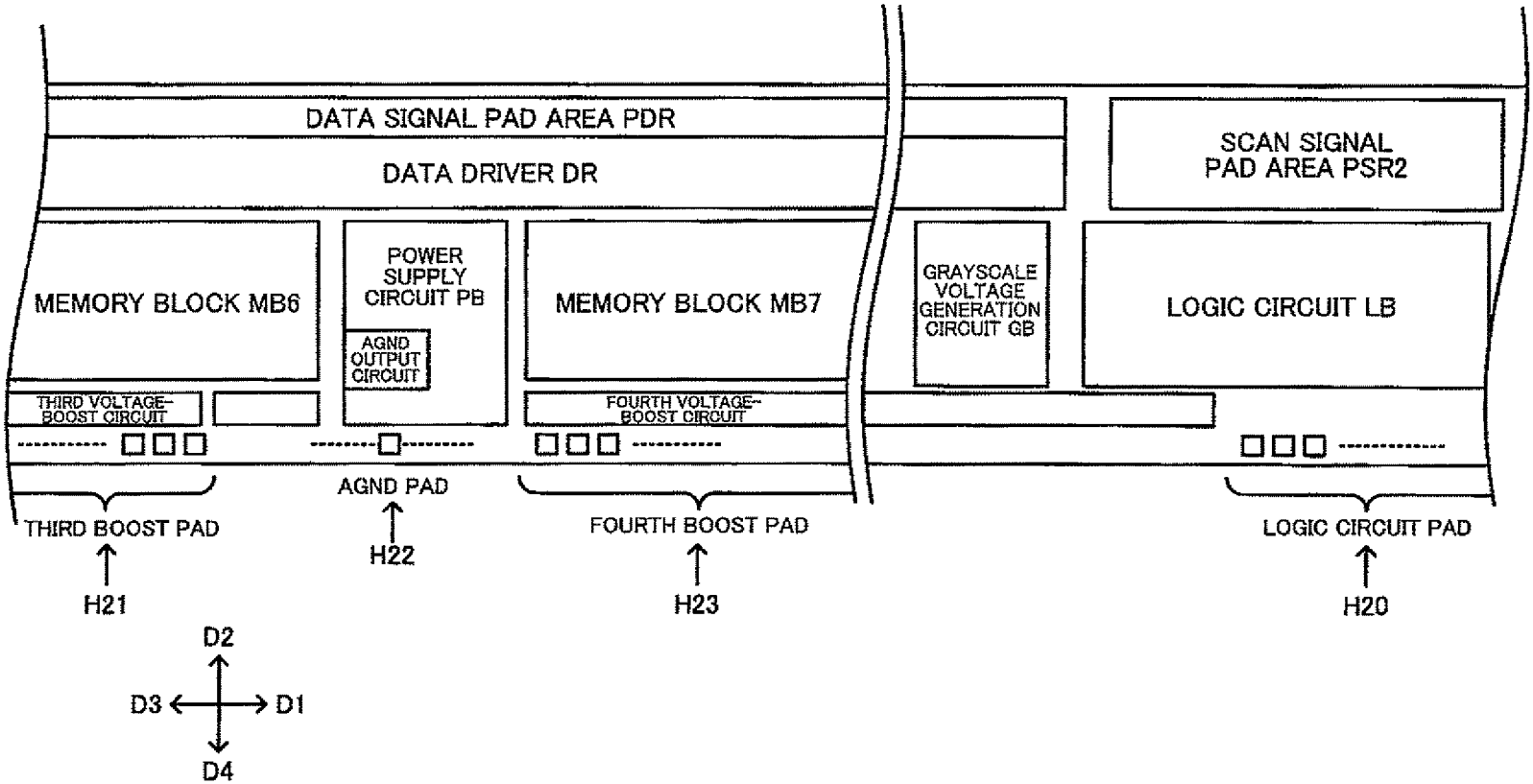
FIG. 17 shows an arrangement example of a logic circuit pad, an AGND pad, and a voltage-boost pad.

FIG. 17 shows the arrangement relationship among the third voltage-boost pad, the AGND pad, the fourth voltage-boost pad, and a logic circuit pad. The logic circuit LB controls the power supply circuit PB and the data driver DR, for example. Specifically, the logic circuit LB outputs control signals (control data) and the like to the power supply circuit PB and the data driver DR to control the power supply circuit PR and the data driver DR.

As indicated by H20 in FIG. 17, the logic circuit pad is disposed in the direction D1 with respect to the third voltage-boost pad, the AGND pad, and the fourth voltage-boost pad indicated by H21, H22, and H23.

According to this layout, the third voltage-boost pad, the AGND pad, and the fourth voltage-boost pad connected the external capacitors can be disposed separately from the logic circuit pad that is not connected to an external capacitor. Therefore, the pads connected to the external capacitors can be disposed collectively so that mounting can be simplified. Moreover, since a line connected to the logic circuit pad on the circuit board does not hinder connection of the capacitor, the mounting efficiency can be improved.

8. Data Driver

Figure 18:
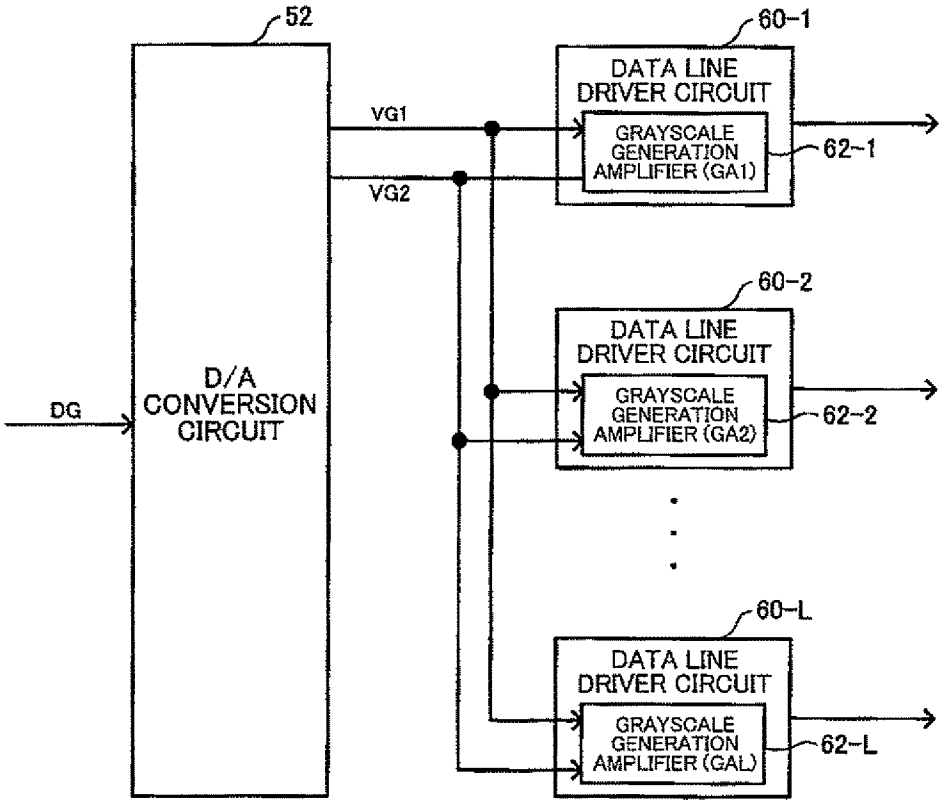
FIG. 18 shows a configuration example of a data driver.

A detailed configuration example of the data driver is described below with reference to FIG. 18. FIG. 18 shows a configuration example of each of the sub-driver blocks SDB0 to SDB5 of the data driver described with reference to FIGS. 10, 12, and the like. Each sub-driver block includes a D/A conversion circuit 52 and data line driver circuits 60-1 to 60-L. In FIG. 18, the D/A conversion circuit 52 is shared by the data line driver circuits 60-1 to 60-L (first to Lth data line driver circuits). Note that the data line driver circuit and the like may be provided corresponding to each data line of the electro-optical panel, or the data line driver circuit may drive a plurality of data lines by time division. Part or the entirety of the data driver (integrated circuit device) may be integrally formed on the electro-optical panel.

The D/A conversion circuit 52 (voltage generation circuit) receives grayscale data DG (image data or display data) from the memory 20 shown in FIG. 1, for example. The D/A conversion circuit 52 outputs a first grayscale voltage VG1 and a second grayscale voltage VG2 corresponding to the grayscale data DG.

Specifically, the D/A conversion circuit 52 receives the grayscale data, and outputs the first grayscale voltage VG1 and the second grayscale voltage VG2 corresponding to the grayscale data by time division in each of the first to Lth sample periods.

The data line driver circuits 60-1 to 60-L respectively include grayscale generation amplifiers 62-1 to 62-L (GA1 to GAL). The grayscale generation amplifiers 62-1 to 62-L sample the first grayscale voltage VG1 and the second grayscale voltage VG2 output from the D/A conversion circuit 52 in each of the first to Lth sample periods, and generate a grayscale voltage between the first grayscale voltage VG1 and the second grayscale voltage VG2.

Figure 19:
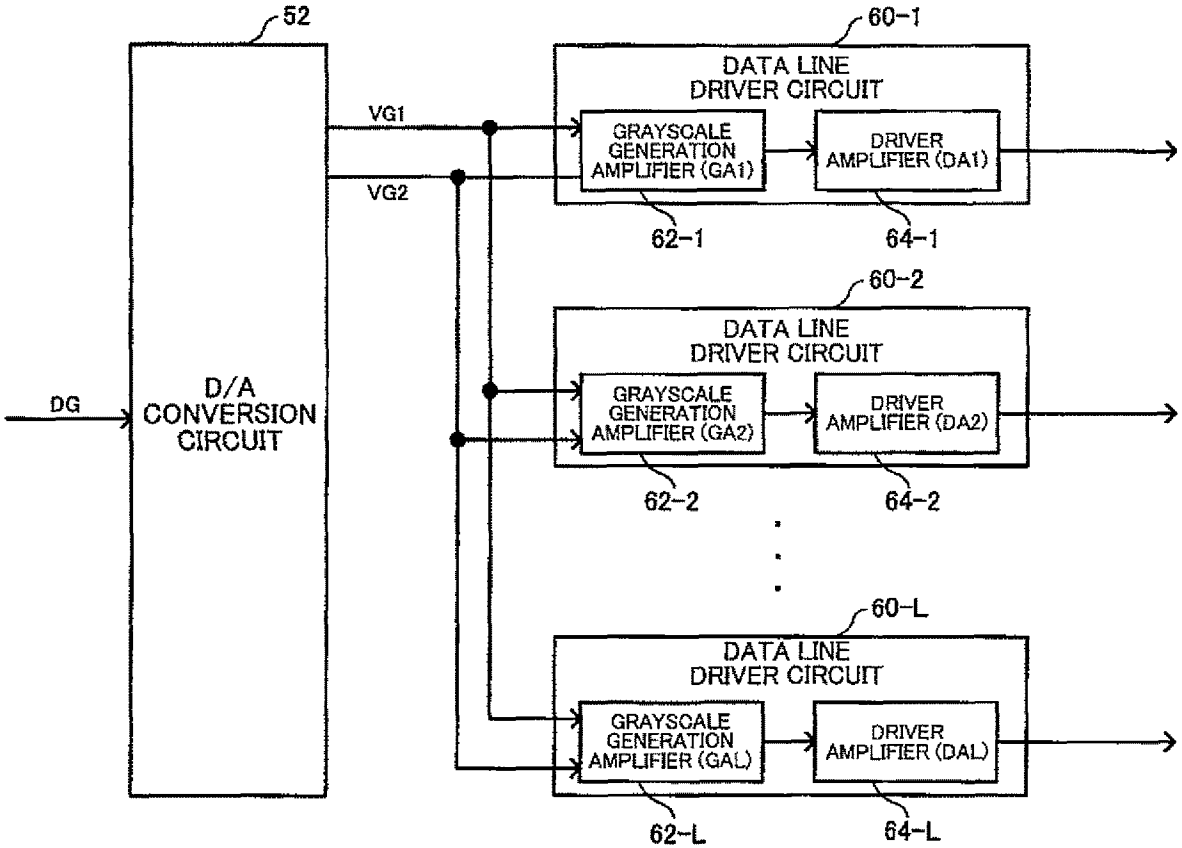
FIG. 19 shows a second configuration example of a data driver.

FIG. 19 shows a second configuration example of the data driver (sub-driver block). In FIG. 19, the data line driver circuits 60-1 to 60-L further include driver amplifiers 64-1 to 64-L (first to Lth driver amplifiers) provided in the subsequent stage of the grayscale generation amplifiers 62-1 to 62-L, respectively, The driver amplifiers 64-1 to 64-L (DA1 to DAL) included in the data line driver circuits 60-1 to 60-L respectively sample the output voltages from the grayscale generation amplifiers 62-1 to 62-L in a driver amplifier sample period after the first to Lth sample periods. The driver amplifiers 64-1 to 64-L output the sampled output voltages in a driver amplifier hold period after the driver amplifier sample period.

Figure 20:
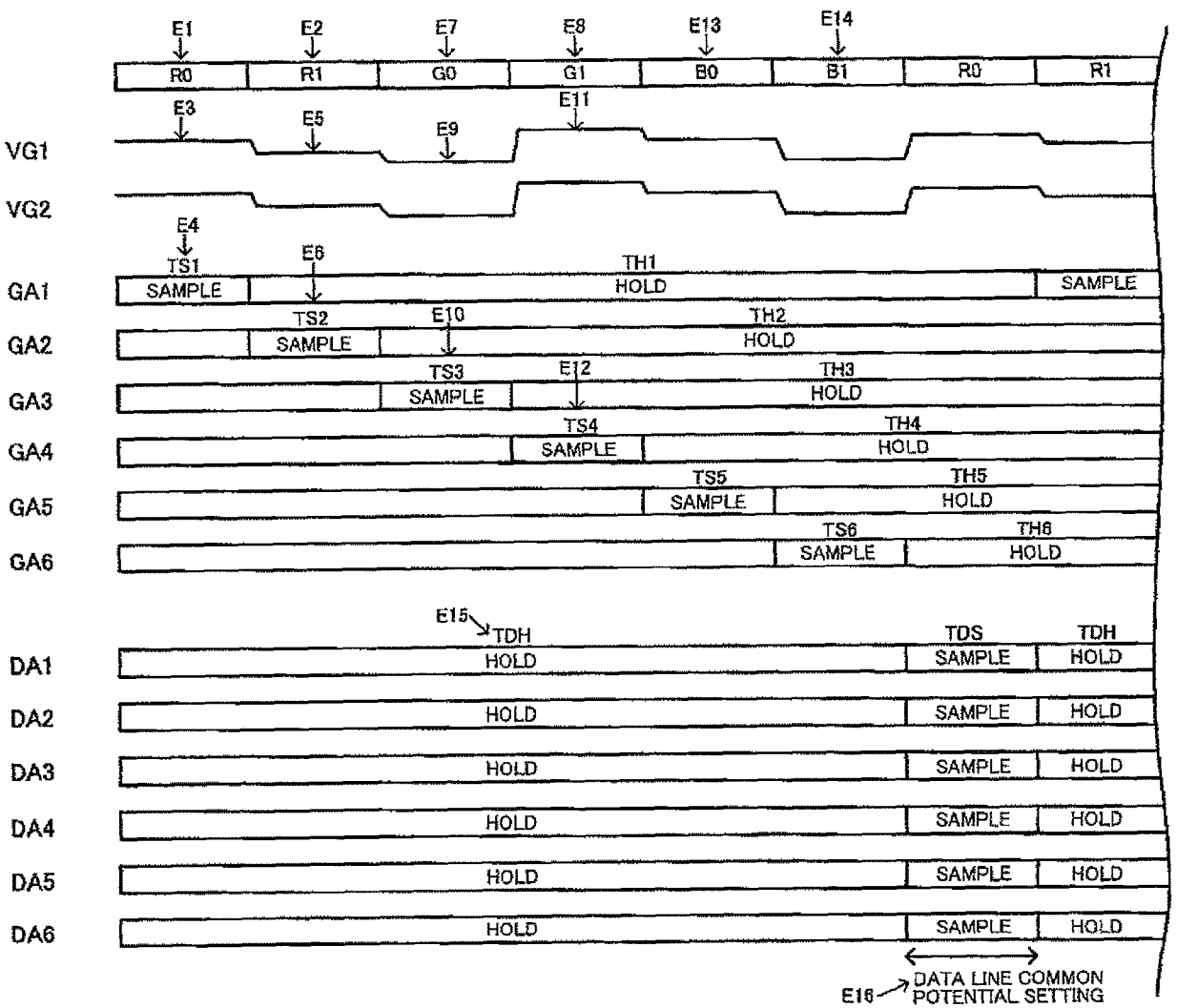
FIG. 20 shows a signal waveform example illustrative of the operation of a data driven

FIG. 20 shows a signal waveform example when the D/A conversion circuit 52 is shared by six data line driver circuits GA1 to GA6. The data line driver circuits GA1 to GA6 perform a sample operation in sample periods TS1 to TS6 (first to Lth sample periods), and perform a hold operation in hold periods TH1 to TH6 (first to Lth hold periods) after the sample periods TS1 to TS6, respectively.

The driver amplifiers DA1 to DA6 perform a sample operation in a driver amplifier sample period TDS after the sample periods TS1 to TS6, and perform a hold operation in a driver amplifier hold period TDH after the driver amplifier sample period TDS.

According to the configuration shown in FIGS. 18 and 19, it suffices to provide one D/A conversion circuit 52 corresponding to the data line driver circuits 60-1 to 60-L instead of providing the D/A conversion circuit corresponding to each data line driver circuit. Therefore, the area occupied by the D/A conversion circuit 52 in the integrated circuit device can be reduced so that the size of the integrated circuit device can be reduced.

Even if the D/A conversion circuit 52 outputs the first grayscale voltage VG1 and the second grayscale voltage VG2 by time division, a voltage can be appropriately sampled in each of the first to Lth sample periods by utilizing the sample function of the grayscale generation amplifiers 62-1 to 62-L.

When using the D/A conversion circuit 52 by time division, the total time of the sample periods TS1 to TS6 increases, as shown in FIG. 20. Therefore, the hold period TH6 of the grayscale generation amplifier GA6 decreases so that the data line drive time becomes insufficient, for example.

However, when the driver amplifiers DA1 to DA6 are provided in the subsequent stage of the grayscale generation amplifiers GA1 to GA6 (see FIG. 19), the driver amplifiers DA1 to DA6 are set in a hold operation mode in the sample periods TS1 to TS6 (see E15 in FIG. 20) so that the data lines can be driven. Therefore, since the data line drive time can be increased, a highly accurate voltage can be supplied to the data line.

A data driver normally performs a DAC drive operation that directly drives the data line using a D/A conversion circuit in the latter half of a drive period in order to increase the accuracy of the voltage supplied to the data line. Therefore, since it is necessary to provide a D/A conversion circuit having an identical configuration corresponding to each data line, the size of the integrated circuit device increases due to an increase in the layout area of the D/A conversion circuits.

On the other hand, an offset-free state can be implemented by forming the grayscale generation amplifier and the driver amplifier having a sample-hold function using a flip-around sample-hold circuit, for example. Therefore, since a highly accurate voltage can be supplied to the data line by minimizing a variation in the voltage output to the data line, the above-mentioned DAC drive operation becomes unnecessary. This makes it unnecessary to provide a D/A conversion circuit having an identical configuration corresponding to each data line. Therefore, one D/A conversion circuit can be shared by a plurality of data line driver circuits, as shown in FIGS. 18 and 19. As a result, the accuracy of the voltage supplied to the data line can be increased while reducing the area of the data driver.

The configuration shown in FIGS. 18 and 19 also has an advantage in that a grayscale voltage line can be utilized for R (red), G (green), and B (blue) by time division.

For example, suppose that a data transfer bus (grayscale data bus) that connects the memory 20 and the data driver 50 shown in FIG. 1 is a 16-bit bus. Suppose that the number of bits of each of R, G, and B subpixels is 8 bits, and the number of bits of the pixel formed by the R, G, and B subpixels is 24 (=8×3) bits.

In this case, the 8-bit subpixel image data R0 (grayscale data) corresponding to the first pixel and the 8-bit subpixel image data R1 (grayscale data) corresponding to the second pixel adjacent to the first pixel are transferred from each memory block to each data driver block through the 16-bit data transfer bus (grayscale data bus) described with reference to FIG. 6 (E1 and E2 in FIG. 20).

The D/A conversion circuit 52 outputs the first grayscale voltage VG1 and the second grayscale voltage VG2 corresponding to the 8-bit subpixel image data R0 (E3 in FIG. 20). The grayscale generation amplifier GA1 samples the first grayscale voltage VG1 and the second grayscale voltage VG2 in the sample period TS1, and generates a grayscale voltage between the first grayscale voltage VG1 and the second grayscale voltage VG2 (E4).

The D/A conversion circuit 52 outputs the first grayscale voltage VG1 and the second grayscale voltage VG2 corresponding to the 8-bit subpixel image data R1 (E5). The grayscale generation amplifier GA2 then samples the first grayscale voltage VG1 and the second grayscale voltage VG2 in the sample period TS2, and generates a grayscale voltage between the first grayscale voltage VG1 and the second grayscale voltage VG2 (E6).

As indicated by E7 and E8, the 8-bit subpixel image data G0 and the 8-bit subpixel image data G1 corresponding to the second pixel are transferred from each memory block to each data driver block through the 16-bit data transfer bus (grayscale data bus).

The D/A conversion circuit 52 outputs the first grayscale voltage VG1 and the second grayscale voltage VG2 corresponding to the 8-bit subpixel image data G0 (E9). The grayscale generation amplifier GA3 then samples the first grayscale voltage VG1 and the second grayscale voltage VG2 in the sample period TS3, and generates a grayscale voltage between the first grayscale voltage VG1 and the second grayscale voltage VG2 (E10).

The D/A conversion circuit 52 outputs the first grayscale voltage VG1 and the second grayscale voltage VG2 corresponding to the 8-bit subpixel image data G1 (E11). The grayscale generation amplifier GA4 then samples the first grayscale voltage VG1 and the second grayscale voltage VG2 in the sample period TS4, and generates a grayscale voltage between the first grayscale voltage VG1 and the second grayscale voltage VG2 (E12). The subpixel image data B0 and B1 is transferred at E13 and E14, and the above-described process is performed.

According to this configuration, it is unnecessary to separately provide R, G, and B grayscale voltage lines. Specifically, one grayscale voltage line can be used by time division for transferring the R, G, and B grayscale voltages. For example, the grayscale voltage line can be used for R at E1 and E2 in FIG. 20, can be used for G at E7 and E8, and call be used for B at E13 and E14.

For example, when sixty-four grayscale voltage lines are necessary for R, G, and B, respectively, 192 (=64×3) grayscale voltage lines must be provided when separately providing R, G, and B grayscale voltage lines.

According to this embodiment, since one grayscale voltage line is used for R, G, and B by time division, only sixty-four grayscale voltage lines are necessary. Therefore, the wiring area of the grayscale voltage lines can be significantly reduced so that the area of the integrated circuit device can be reduced, Note that this embodiment employs a data line common potential setting method (equalization) in order to reduce power consumption. Specifically, the output lines of the driver amplifiers DA1 to DA6 are set at a common potential (e.g., common voltage VCOM) in the driver amplifier sample period TDS, as indicated by E16 in FIG. 20. For example, the output lines of the driver amplifiers DA1 to DA6 are set at the common voltage VCOM (i.e., common potential). Note that the common potential is not limited to the common voltage VCOM, but may be a GND potential or the like.

According to this configuration, since the data lines of the electro-optical panel are charged and discharged by recycling a charge stored in the electro-optical panel, power consumption can be further reduced.

9. Switch Circuit

Various modifications of the data driver according to this embodiment are described below. In the following description, the data line driver circuits 60-1 to 60-L, the grayscale generation amplifiers 62-1 to 62-L, and the driver amplifiers 64-1 to 64-L that share the D/A conversion circuit 52 are respectively referred to as a data line driver circuit 60, a grayscale generation amplifier 62, and a driver amplifier 64 for convenience of illustration.

Figure 21:
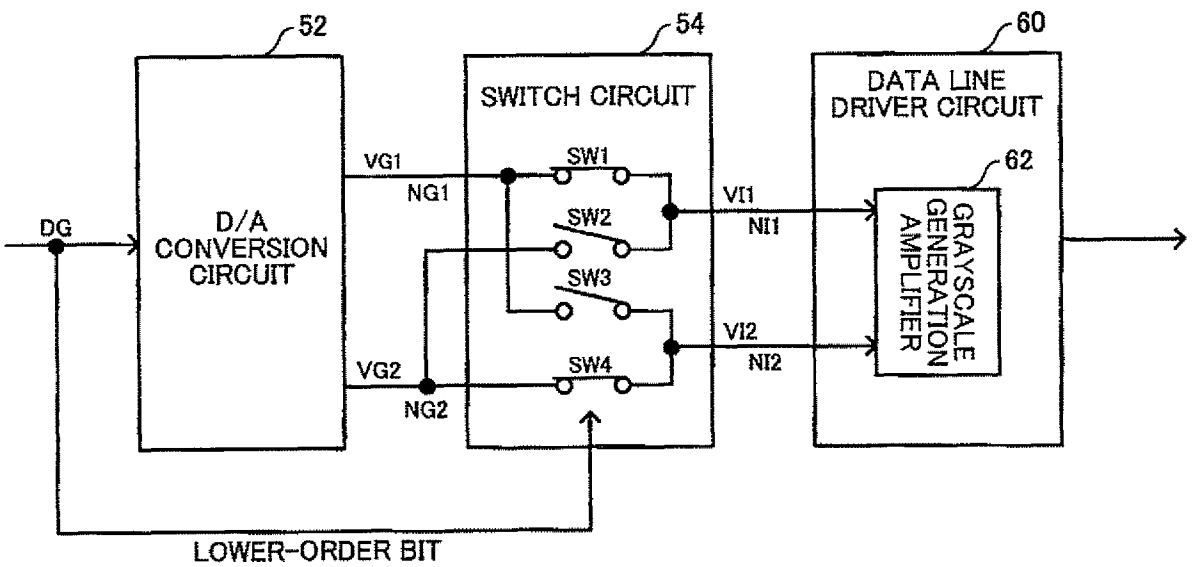
FIG. 21 shows a modification of a data driver.

FIG. 21 shows a modification of the data driver according to this embodiment. A switch circuit 54 is additionally provided in this modification. In FIG. 21, the D/A conversion circuit 52 receives a plurality of grayscale voltages (e.g., V0 to V128 or V0 to V64) from the grayscale voltage generation circuit 110 shown in FIG. 1 through the grayscale voltage lines. The D/A conversion circuit 52 selects and outputs the first grayscale voltage VG1 and the second grayscale voltage VG2 corresponding to the grayscale data DG from the plurality of grayscale voltages. In this case, the first grayscale voltage VG1 and the second grayscale voltage VG2 output from the D/A conversion circuit 52 are consecutive (adjacent) grayscale voltages. Specifically, the first grayscale voltage VG1 and the second grayscale voltage VG2 are consecutive grayscale voltages (e.g., V0 and V1, V1 and V2, or V2 and V3) among a plurality of grayscale voltages (V0 to V128 or V0 to V64) input to the D/A conversion circuit 52 through the grayscale voltage lines.

In FIG. 22, the grayscale data DG is 8-bit (256-grayscale) data (D7 to D0), for example. A plurality of grayscale voltages V0 to V128 are input to the D/A conversion circuit 52. The grayscale voltages V0 to V128 have a monotonically decreasing relationship (i.e., V0>V1>V2 . . . V127>V128). Note that the grayscale voltages V0 to V128 may have a monotonically increasing relationship (i.e., V0<V1<V2 . . . V127<V128).

The D/A conversion circuit 52 outputs the grayscale voltage V1 and the grayscale voltage V0 as the first grayscale voltage VG1 and the second grayscale voltage VG2 (i.e., VG1=V1 and VG2=V0), respectively, when the grayscale data DG (D7 to D0) is (00000000) or (00000001), and outputs the grayscale voltage V1 and the grayscale voltage V2 as the first grayscale voltage VG1 and the second grayscale voltage VG2 (i.e., VG1=V1 and VG2=V2), respectively, when the grayscale data DG (D7 to D0) is (00000010) or (00000011). The D/A conversion circuit 52 outputs the grayscale voltage V3 and the grayscale voltage V2 as the first grayscale voltage VG1 and the second grayscale voltage VG2 (i.e., VG1=V3 and VG2=V2), respectively, when the grayscale data DG (D7 to D0) is (00000100) or (00000101), and outputs the grayscale voltage V3 and the grayscale voltage V4 as the first grayscale voltage VG1 and the second grayscale voltage VG2 (i.e., VG1=V3 and VG2=V4), respectively, when the grayscale data DG (D7 to D0) is (00000110) or (00000111).

The D/A conversion circuit 52 thus outputs consecutive grayscale voltages corresponding to the grayscale data DG among the grayscale voltages V0 to V128 input from the grayscale voltage generation circuit 110 as the first grayscale voltage VG1 and the second grayscale voltage VG2. Although FIGS. 21 and 22 illustrate an example in which the D/A conversion circuit 52 generates two grayscale voltages (i.e., first grayscale voltage VG1 and second grayscale voltage VG2), the types (number) of grayscale voltages output from the D/A conversion circuit 52 are not limited thereto.

The data line driver circuit 60 (data line driver circuits 60-1 to 60-L) is a circuit that drives the data line of the electro-optical panel 400, and includes a grayscale generation amplifier 62 (grayscale generation amplifiers 62-1 to 62-L). The grayscale generation amplifier 62 (grayscale generation sample-hold circuit) generates and outputs a grayscale voltage between the first grayscale voltage VG1 and the second grayscale voltage VG2.

In FIG. 22, when the grayscale data DG is (00000001), the grayscale generation amplifier 62 generates (samples) and outputs the voltage (V0-(V0-V1)/2) between the first grayscale voltage VG1 (=V1) and the second grayscale voltage VG2 (=V0) as a grayscale voltage VS. When the grayscale data DG is (00000000), the grayscale generation amplifier 62 outputs the grayscale voltage V0 (=VG2) as the grayscale voltage VS. When the grayscale data DG is (00000011), the grayscale generation amplifier 62 generates and outputs the voltage (V1−(V1−V2)/2) between the first grayscale voltage VG1 (=V1) and the second grayscale voltage VG2 (=V2) as the grayscale voltage VS. When the grayscale data DG is (00000010), the grayscale generation amplifier 62 outputs the grayscale voltage V1 (=VG1) as the grayscale voltage VS.

The switch circuit 54 is provided between the D/A conversion circuit 52 and the data line driver circuit 60. The switch circuit 54 may be an element of the D/A conversion circuit 52 or the data line driver circuit 60.

The switch circuit 54 includes a plurality of switch elements. In FIG. 21, the switch circuit 54 includes a first switch element SW1 to a fourth switch element SW4, for example. Note that the number of switch elements is not limited to four, but may be eight, sixteen, or the like. The switch elements SW1 to SW4 may be formed by CMOS transistors. Specifically, the switch elements SW1 to SW4 may be formed by transfer gates including a P-type transistor and an N-type transistor. These transistors are turned ON/OFF based on switch control signals output from a switch control signal generation circuit (not shown).

The switch element SW1 is provided between a first voltage output node NG1 (i.e., output node of the first grayscale voltage VG1) of the D/A conversion circuit 52 and a first input node NI1 of the grayscale generation amplifier 62 (data line driver circuit 60). The switch element SW2 is provided between a second voltage output node NG2 (i.e., output node of the second grayscale voltage VG2) of the D/A conversion circuit 52 and the input node NI1 of the grayscale generation amplifier 62. The switch element SW1 and the switch element SW2 are exclusively turned ON/OFF. As shown in FIG. 22, the switch element SW1 is turned OFF and the switch element SW2 is turned ON when the grayscale data DG is (00000000), and the switch element SW1 is turned ON and the switch element SW2 is turned OFF when the grayscale data DG is (00000001), for example.

The switch element SW3 is provided between the voltage output node NG1 of the D/A conversion circuit 52 and an input node NI2 of the grayscale generation amplifier 62. The switch element SW4 is provided between the voltage output node NG2 of the D/A conversion circuit 52 and the input node NI2 of the grayscale generation amplifier 62. The switch element SW3 and the switch element SW4 are exclusively turned ON/OFF. For example, the switch element SW3 is turned OFF and the switch element SW4 is turned ON when the grayscale data DG is (00000001), and the switch element SW3 is turned ON and the switch element SW4 is turned OFF when the grayscale data DG is (00000010).

As shown in FIG. 22, when the grayscale data DG is (00000000), the D/A conversion circuit 52 outputs the grayscale voltage V1 and the grayscale voltage V0 as the first grayscale voltage VG1 and the second grayscale voltage VG2, respectively. The switch elements SW1, SW2, SW3, and SW4 of the switch circuit 54 are turned OFF, ON, OFF, and ON, respectively. Therefore, a grayscale voltage VI1 (=VG2=V0) and a grayscale voltage VI2 (=VG2=V0) are respectively input to the input node NI1 and the input node NI2 of the grayscale generation amplifier 62. The grayscale generation amplifier 62 thus outputs the grayscale voltage V0 as the grayscale voltage VS (sample voltage).

When the grayscale data DG is (00000001), the switch elements SW1, SW2, SW3, and SW4 are turned ON, OFF, OFF, and ON, respectively. Therefore, the grayscale voltage VI1 (=VG1=V1) and the grayscale voltage VI2 (=VG2=V0) are respectively input to the input node NI1 and the input node NI2 of the grayscale generation amplifier 62 so that the grayscale generation amplifier 62 outputs the voltage V0-(V0-V1)/2) as the grayscale voltage VS. Specifically, the grayscale generation amplifier 62 outputs the grayscale voltage corresponding to the grayscale data DG (=00000001)).

When the grayscale data DG is (00000010), the D/A conversion circuit 52 outputs the grayscale voltage V1 and the grayscale voltage V2 as the first grayscale voltage VG1 and the second grayscale voltage VG2, respectively. The switch elements SW1, SW2, SW3, and SW4 are turned ON, OFF, ON, and OFF, respectively. Therefore, the grayscale voltage VI1 (=VG1=V1) and the grayscale voltage VI2 (=VG1=V1) are respectively input to the input node NI1 and the input node NI2 of the grayscale generation amplifier 62 so that the grayscale generation amplifier 62 outputs the grayscale voltage V1 as the grayscale voltage VS.

When the grayscale data DG is (00000011), the switch elements SW1, SW2, SW3, and SW4 are turned OFF, ON, ON, and OFF, respectively. Therefore, the grayscale voltage VI1 (=VG2=V2) and the grayscale voltage VI2 (=VG1=V1) are respectively input to the input node NI1 and the input node NI2 of the grayscale generation amplifier 62 so that the grayscale generation amplifier 62 outputs the voltage (V1−(V1−V2)/2) as the grayscale voltage VS. Specifically, the grayscale generation amplifier 62 outputs the grayscale voltage corresponding to the grayscale data DG (=(00000011)).

As shown in FIG. 22, the switch elements SW1 to SW4 are turned ON/OFF based on the lower-order bits of the grayscale data DG. Specifically, the switch elements SW1 to SW4 are turned ON/OFF based on switch control signals that are generated based on the lower-order bits of the grayscale data DG. For example, when the lower-order bits D1 and D0 of the grayscale data DG are (00), the switch elements SW1, SW2, SW3, and SW4 are turned OFF, ON, OFF, and ON, respectively, as shown in FIG. 22. When the lower-order bits D1 and D0 of the grayscale data DG are (01), the switch elements SW1, SW2, SW3, and SW4 are turned ON, OFF, OFF, and ON, respectively. When the lower-order bits D1 and D0 of the grayscale data DG are (10), the switch elements SW1, SW2, SW3, and SW4 are turned ON, OFF, ON, and OFF, respectively. When the lower-order bits D1 and D0 of the grayscale data D0 are (11), the switch elements SW1, SW2, SW3, and SW4 are turned OFF, ON, ON, and OFF, respectively.

Since the above-described data driver can generate the grayscale voltage using the grayscale generation amplifier 62, the number (types) of grayscale voltages generated by the grayscale voltage generation circuit 110 shown in FIG. 1 can be reduced. This makes it possible to reduce the number of grayscale voltage lines while reducing the circuit scale of the D/A conversion circuit 52.

For example, when the number of bits of the grayscale data DG is eight (i.e., the number of grayscales is $2^8$ (=256)), the grayscale voltage generation circuit 110 must generate 256 grayscale voltages when using a related-art method. Therefore, the D/A conversion circuit 52 must include selectors that select the grayscale voltages corresponding to the grayscale data DG from the 256 grayscale voltages. This increases the size of the grayscale voltage generation circuit 110 and the D/A conversion circuit 52. Moreover, since 256 grayscale voltage lines are required, the wiring area increases.

On the other hand, since the data driver shown in FIG. 21 generates the grayscale voltage using the grayscale generation amplifier 62, it suffices that the grayscale voltage generation circuit 110 generate 128 grayscale voltages, for example. Therefore, it suffices that the D/A conversion circuit 52 include selectors that select voltages from the 128 grayscale voltages. Accordingly, the circuit scale can be significantly reduced as compared with the related-art method. Moreover, since the number of grayscale voltage lines can be reduced to 128, the wiring area can be significantly reduced. Note that 129 (=128+1) grayscale voltage lines are required in the above-described case since the grayscale generation amplifier 62 generates a voltage by dividing the voltage between the first grayscale voltage VG1 and the second grayscale voltage VG2.

According to the data driver shown in FIG. 21, the grayscale generation amplifier 62 has a sample-hold function. Therefore, a voltage that varies to only a small extent can be supplied to the data line without performing a DAC drive operation that directly drives the data line using the D/A conversion circuit 52. Specifically, an accurate voltage can be supplied to the data line by a relatively small and simple circuit configuration. Since the grayscale generation amplifier 62 has a sample-hold function, a plurality of data line driver circuits 60 can share one D/A conversion circuit 52. Therefore, the circuit scale can be further reduced.

According to the data driver shown in FIG. 21, the switch circuit 54 is provided between the D/A conversion circuit 52 and the data line driver circuit 60. Therefore, the input voltages (VI1, VI2)=(V0, V0), (V1, V0), (V1, V1), (V2, V1), . . . can be input to the grayscale generation amplifier 62 (see FIG. 22) based on the first grayscale voltage VG1 and the second grayscale voltage VG2 output from the D/A conversion circuit 52, for example. As a result, the grayscale generation amplifier 62 can output a grayscale voltage that decreases monotonically (or increases monotonically) (e.g., VS=V0, V0−(V0−V1)/2, V1, V1−(V1−V2)/2, V2, . . . ) so that an appropriate grayscale voltage can be output by a simple circuit configuration.

10. Flip-around Sample-hold Circuit

The grayscale generation amplifier 62 may be formed by a flip-around sample-hold circuit. The term "flip-around sample-hold circuit" refers to a circuit that samples a charge corresponding to an input voltage using a sampling capacitor in a sample period, and performs a flip-around operation of the sampling capacitor in a hold period to output a voltage corresponding to the stored charge to its output node, for example.

The flip-around sample-hold circuit is described in detail below with reference to FIGS. 23A and 23B.

In FIGS. 23A and 23B, the grayscale generation amplifier 62 formed by a flip-around sample-hold circuit includes an operational amplifier OP1 and first and second sampling capacitors CS1 and CS2 (a plurality of sampling capacitors), for example.

The sampling capacitor CS1 is provided between an inverting input terminal (first input terminal) of the operational amplifier OP1 and the input node NI1 of the grayscale generation amplifier 62. As shown in FIG. 23A, the capacitor CS1 stores a charge corresponding to the input voltage VI1 at the input node NI1 in the sample period.

The sampling capacitor CS2 is provided between the inverting input terminal of the operational amplifier OP1 and the input node NI2 of the grayscale generation amplifier 62. The capacitor CS2 stores a charge corresponding to the input voltage VI2 at the input node NI2 in the sample period.

As shown in FIG. 23A, the output from the operational amplifier OP1 is fed back to a node NEG of the inverting input terminal of the operational amplifier OP1 in the sample period. A non-inverting input terminal (second input terminal) of the operational amplifier OP1 is set at the analog reference power supply voltage AGND. Therefore, the node NEG connected to one end of the capacitors CS1 and CS2 is set at the reference power supply voltage AGND due to a virtual short-circuit function of the operational amplifier OP1. As a result, charges corresponding to the input voltages VI1 and VI2 are respectively stored in the capacitors CS1 and CS2.

In the hold period, the grayscale generation amplifier 62 outputs an output voltage VQG (=VS) corresponding to the charges stored in the sampling capacitors CS1 and CS2 in the sample period to an output node NQG, as shown in FIG. 23B. Specifically, the grayscale generation amplifier 62 outputs the output voltage VQG corresponding to the charges stored in the sampling capacitors CS1 and CS2 by performing a flip-around operation that connects the other end of the capacitors CS1 and CS2 connected to the node NEG at one end to an output terminal of the operational amplifier OP1.

An off-set-free state can be implemented by forming the grayscale generation amplifier 62 using the above-described flip-around sample-hold circuit.

For example, an offset voltage generated between the inverting input terminal and the non-inverting input terminal of the operational amplifier OP1 is referred to as VOF, the analog reference power supply voltage AGND is set at 0 V for convenience, the input voltages in the sample period are set at VI1=VI2=VI, and the parallel capacitance of the capacitors CS1 and CS2 (connected in parallel) is referred to as CS. In this case, a charge Q stored in the sample period is expressed by the following equation.

$$Q=(VI-VOF)\times CS \tag{1}$$

When the voltage of the node NEG in the hold period is referred to as VX and the output voltage is referred to as VQG, a charge Q' stored in the hold period is expressed by the following equation.

$$Q'=(VQG-VX)\times CS \tag{2}$$

When the amplification factor of the operational amplifier OP1 is referred to as A, the output voltage VQG is expressed by the following equation, $$VQG=-A\times(VX-VOF) \tag{3}$$

Since Q=Q' is satisfied according to the principle of charge conservation, the following equation is satisfied.

$$(VI-VOF)\times CS=(VQG-VX)\times CS \tag{4}$$

Therefore, the following equation is satisfied from the equations (3) and (4).

$$VQG=VI-VOF+VX=VI-VOF+VOF-VQG/A$$

Therefore, the output voltage VQG of the grayscale generation amplifier 62 is expressed by the following equation.

$$VQG=(\{1/(1+1/A)\}\times VI \tag{5}$$

As is clear from the equation (5), since the output voltage VQG of the grayscale generation amplifier 62 is independent of the offset voltage VOF and an offset can be canceled, an offset-free state can be implemented.

FIGS. 24A and 24B show a specific configuration example of the grayscale generation amplifier 62 using the flip-around sample-hold circuit. The grayscale generation amplifier 62 shown in FIGS. 24A and 243 includes the operational amplifier OP1, first and second sampling switch elements SS1 and SS2, the first and second sampling capacitors CS1 and CS2, a feedback switch element SFG, and first and second flip-around switch elements SA1 and SA2. The grayscale generation amplifier 62 also includes an output switch element SQG. Note that modifications may be made such as omitting some of the elements or adding other elements. The switch elements SS1, SS2, SA1, SA2, SFG, and SQG may be formed by CMOS transistors (e.g., transfer gate), for example.

The non-inverting input terminal (second input terminal) of the operational amplifier OP1 is set at the analog reference power supply voltage AGND. The sampling switch element SS1 and the sampling capacitor CS1 are provided between the input node NI1 of the grayscale generation amplifier 62 and the inverting input terminal (first input terminal) of the operational amplifier OP. The sampling switch element SS2 and the sampling capacitor CS2 are provided between the input node NI2 of the grayscale generation amplifier 62 and the inverting input terminal of the operational amplifier OP1.

The feedback switch element SFG is provided between the output terminal and the inverting input terminal of the operational amplifier OP1.

The flip-around switch element SA1 is provided between a first connection node NS1 situated between the switch element SS1 and the capacitor CS1, and the output terminal of the operational amplifier OP1. The flip-around switch element SA2 is provided between a second connection node NS2 situated between the switch element SS2 and the capacitor CS2 and the output terminal of the operational amplifier OP1.

In the sample period, the sampling switch elements SS1 and SS2 and the feedback switch element SFG are turned ON, and the flip-around switch elements SA1 and SA2 are turned OFF, as shown in FIG. 24A.

In the hold period, the sampling switch elements SS1 and SS2 and the feedback switch element SFG are turned OFF, and the flip-around switch elements SA1 and SA2 are turned ON, as shown in FIG. 24B.

The output switch element SQG is provided between the output terminal of the operational amplifier OP1 and the output node NQG of the grayscale generation amplifier 62. In the sample period, the output switch element SQG is turned OFF, as shown in FIG. 24A. This causes the output of the grayscale generation amplifier 62 to be set in a high impedance state so that a situation in which an indefinite voltage in the sample period is transmitted to the subsequent stage can be prevented.

In the hold period, the output switch element SQG is turned ON, as shown in FIG. 24B. Therefore, the voltage VQG (i.e., the grayscale voltage generated in the sample period) can be output.

The operation of the circuit shown in FIGS. 24A and 24B is described below with reference to FIG. 25. The first grayscale voltage VG1 output from the D/A conversion circuit 52 is input to the node NG1, and the second grayscale voltage VG2 that differs in voltage level from the first grayscale voltage VG1 is input to the node NG2.

The switch element SW1 or SW2 of the switch circuit 54 is exclusively turned ON corresponding to the grayscale data DG. The switch element SW3 or SW4 is exclusively turned ON corresponding to the grayscale data DG.

In the sample period, switch control signals input to the sampling switch elements SS1 and SS2 and the feedback switch element SFG are activated (H level) so that the sampling switch elements SS1 and SS2 and the feedback switch element SFG are turned ON. On the other hand, switch control signals input to the flip-around switch elements SA1 and SA2 and the output switch element SQG are inactivated (L level) so that the flip-around switch elements SA1 and SA2 and the output switch element SQG are turned OFF.

In the hold period, the switch control signals input to the sampling switch elements SS1 and SS2 and the feedback switch element SFG are inactivated so that the sampling switch elements SS1 and SS2 and the feedback switch element SFG are turned OFF. On the other hand, the switch control signals input to the flip-around switch elements SA1 and SA2 and the output switch element SQG are activated so that the flip-around switch elements SA1 and SA2 and the output switch element SQG are turned ON.

Figure 25:
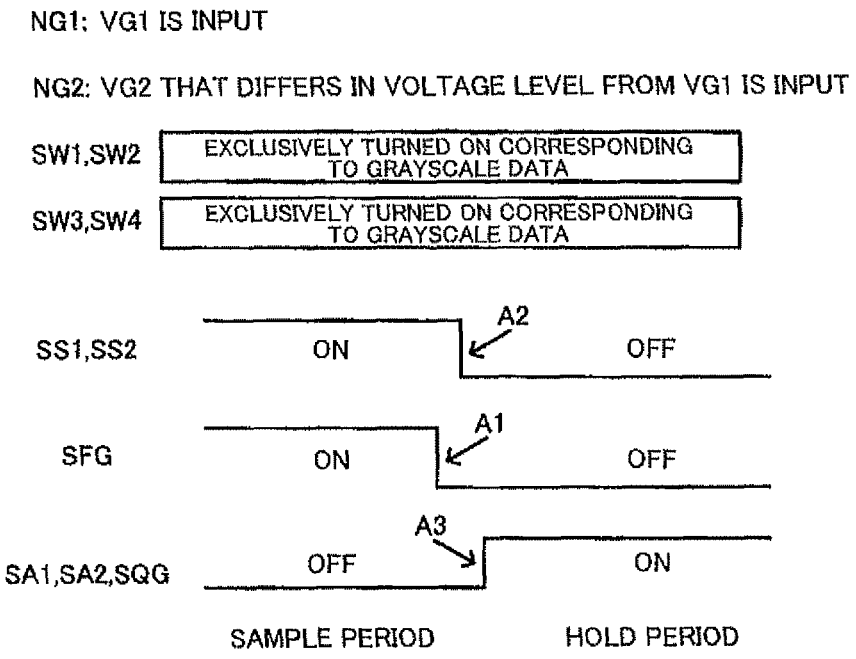
FIG. 25 is a view illustrative of the circuit operation of a grayscale generation amplifier.

The sampling switch elements SS1 and SS2 are turned OFF after the feedback switch element SFG has been turned OFF, as indicated by A1 and A2 in FIG. 25. This minimizes an adverse effect of charge injection. The flip-around switch elements SA1 and SA and the output switch element SQG are turned ON after the sampling switch elements SS1 and SS2 have been turned OFF, as indicated by A3.

Figure 26A:
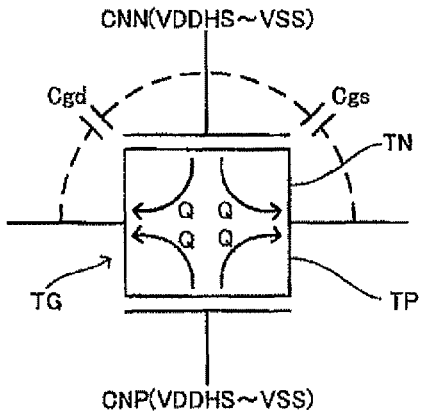
FIG. 26A to 26C are views illustrative of a switch control method according to one embodiment of the invention.

FIG. 26A shows an example of a transfer gate TG used as the switch element. Switch control signals CNN and CNP are respectively input to the gates of an N-type transistor TN and a P-type transistor TP that form the transfer gate TG. When the transfer gate TG is turned OFF, clock feedthrough occurs due to a gate-drain parasitic capacitor Cgd and a gate-source parasitic capacitor Cgs. When the transfer gate TG is turned OFF, a charge in the channel flows into the drain or the source (i.e., charge injection occurs).

Figure 26B:
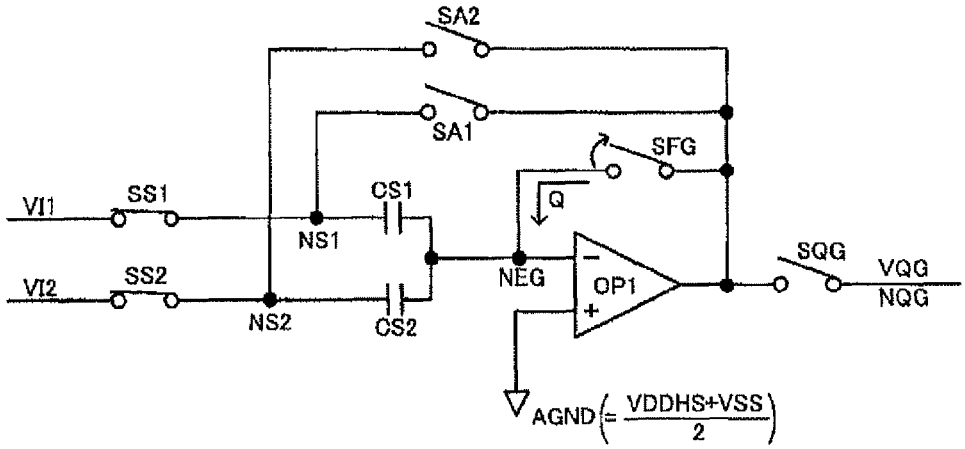
Figure 26C:
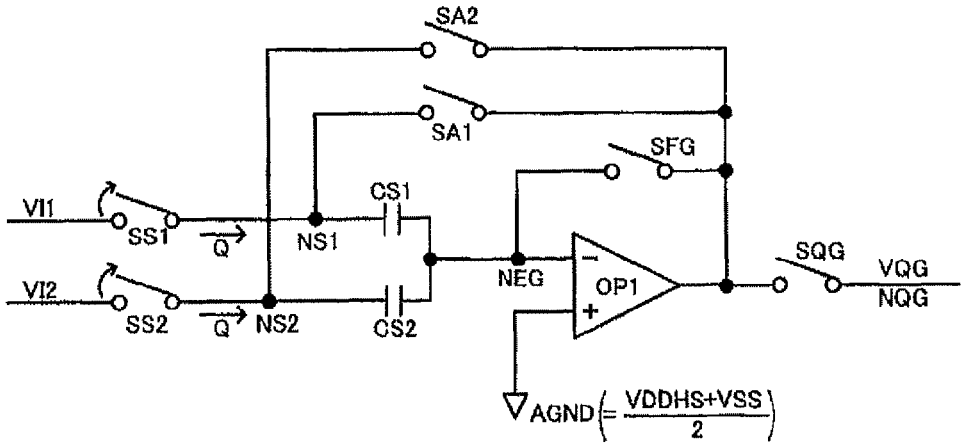

According to this embodiment, since the sampling switch elements SS1 and SS2 are turned OFF (see FIG. 26C) after the feedback switch element SFG has been turned OFF (see FIG. 26B), an adverse effect of charge injection or clock feedthrough can be reduced.

Specifically, if the switch element SFG is turned OFF when the switch elements SS1 and SS2 are set in an ON state (see FIG. 26B), an adverse effect of charge injection or clock feedthrough via the switch element SFG occurs. However, the switch element SFG has been turned OFF (i.e., the node NEG has been set in a high impedance state) when the switch elements SS1 and SS2 are turned OFF (see FIG. 26C). Therefore, an adverse effect of charge injection or clock feedthrough via the switch elements SS1 and SS2 does not occur. As a result, an adverse effect of charge injection or clock feedthrough can be reduced.

The switch control signals CNN and CNP having an amplitude between VDDHS and VSS are input to the gates of the transistors TN and TP of the transfer gate TG shown in FIG. 26A. Therefore, when the potential of the drain or the source of the transfer gate TG is set at VSS or VDDHS, an imbalance occurs between the amount of charge from the N-type transistor TN and the amount of charge from the P-type transistor TP. As a result, a charge due to charge injection remains without being canceled.

According to this embodiment, the non-inverting input terminal of the operational amplifier OP1 is set at the analog reference power supply voltage AGND (i.e., the intermediate voltage between the voltage VDDHS and the voltage VSS) immediately before the switch element SFG is turned OFF (see FIG. 26B), and the potential of the node NEG is set at the analog reference power supply voltage AGND (=(VDDHS+VSS)/2) due to the virtual short-circuit function of the operational amplifier OP1. Therefore, since the source and the drain of the switch element SFG are set at the analog reference power supply voltage AGND (i.e., independent of the input grayscale voltage) immediately before the switch element SFG is turned OFF and an imbalance between the amount of charge from the N-type transistor and the amount of charge from the P-type transistor can be reduced, an adverse effect of charge injection that occurs when the switch element SFG is turned OFF can be minimized.

11. Electronic Instrument

Figure 27A:
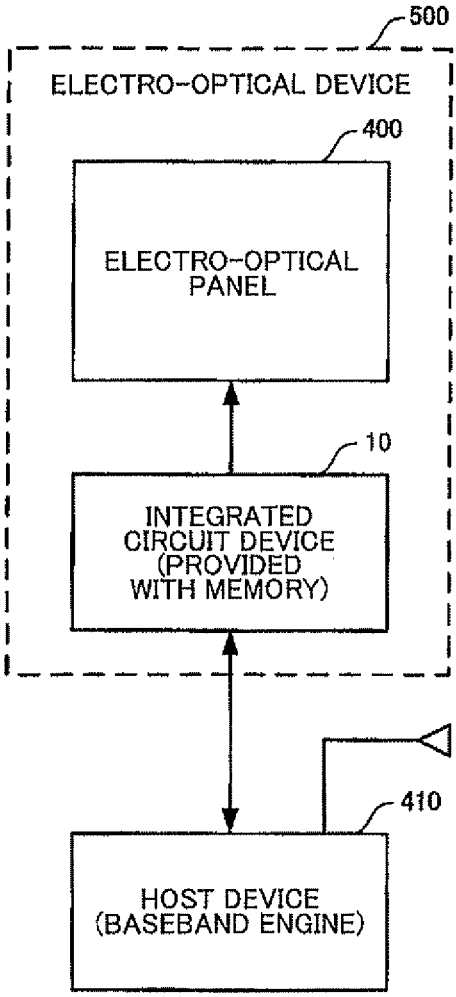
FIGS. 27A and 27B show configuration examples of an electronic instrument.
Figure 27B:
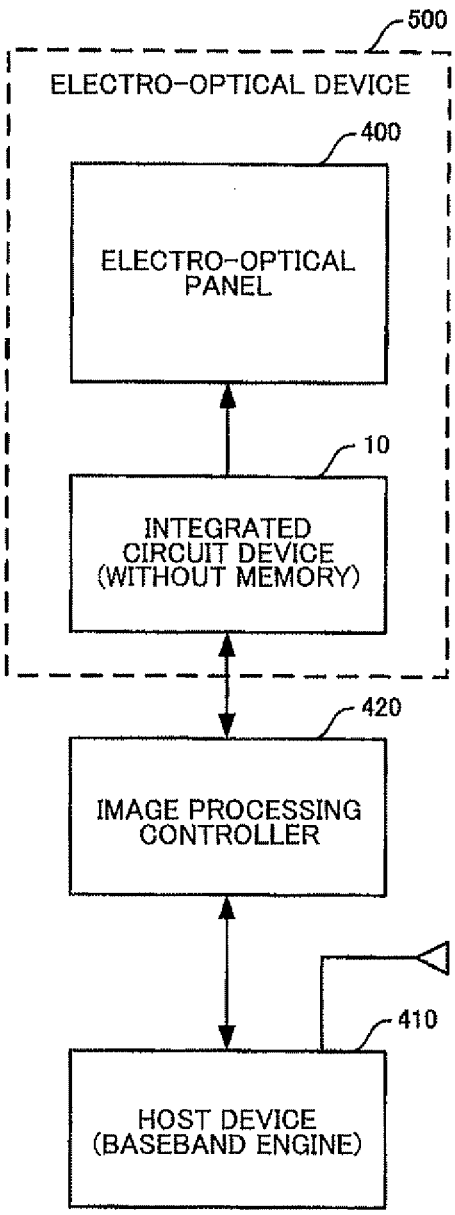

FIGS. 27A and 27B show configuration examples of an electronic instrument and an electro-optical device 500 including the integrated circuit device 10 according to the above embodiment. Note that various modifications may be made such as omitting some of the elements shown in FIGS. 27A and 27B or adding other elements (e.g., camera, operation section, or power supply). The electronic instrument according to this embodiment is not limited to a portable telephone, but may be a digital camera, a PDA, an electronic notebook, an electronic dictionary, a television, a projector, a portable information terminal, or the like.

In FIGS. 27A and 27B, a host device 410 is an MPU, a baseband engine, or the like. The host device 410 controls the integrated circuit device 10 (i.e., display driver). The host device 410 may also perform a process of an application engine or a baseband engine, or a process (e.g., compression, decompression, or sizing) of a graphic engine. An image processing controller 420 shown in FIG. 27B performs a process of a graphic engine, such as compression, decompression, or sizing, instead of the host device 410.

In FIG. 27A, the integrated circuit device 10 may include a memory. In this case, the integrated circuit device 10 writes image data output from the host device 410 into the built-in memory, reads the image data from the built-in memory, and drives the electro-optical panel. In FIG. 27B, the integrated circuit device 10 may not include a memory. In this case, image data output from the host device 410 is written into a built-in memory of the image processing controller 420. The integrated circuit device 10 drives the electro-optical panel 400 under control of the image processing controller 420.

Although some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g., inverting input terminal and non-inverting input terminal) cited with a different term (e.g., first input terminal and second input terminal) having a broader meaning or the same meaning at least once in the specification and the drawings may be replaced by the different term in any place in the specification and the drawings. The configurations and the operations of the integrated circuit device, the electro-optical device, and the electronic instrument are not limited to those described in the above embodiments. Various modifications and variations may be made.

What is claimed is:

1. An integrated circuit device comprising:

first to Nth (N is an integer equal to or larger than two) memory blocks that are disposed along a first direction and store image data;

a power supply circuit that generates a power supply voltage; and a data driver that is disposed along the first direction and spaced from the first to Nth memory blocks in a second direction, the second direction being perpendicular to the first direction and supplying data signals to a plurality of data lines of an electro-optical device, the power supply circuit including an analog reference power supply voltage output circuit that outputs an analog reference power supply voltage;

the analog reference power supply voltage output circuit being disposed between an Mth (M is a natural number) memory block and an (M+1)th memory block among the first to Nth memory blocks; and an analog reference power supply line that supplies the analog reference power supply voltage being provided in an area of the data driver along the first direction, the analog reference power supply voltage being supplied to a second input terminal of an operational amplifier that is included in a sample-hold circuit included in the data driver and has a first input terminal and the second input terminal.

2. The integrated circuit device as defined in claim 1, the analog reference power supply voltage being supplied to a second input terminal of an operational amplifier that is included in the data driver and has a first input terminal and the second input terminal.

3. The integrated circuit device as defined in claim 2, the analog reference power supply voltage being set at a voltage between a high-potential-side power supply voltage and a low-potential-side power supply voltage of the operational amplifier.

4. The integrated circuit device as defined in claim 1, the analog reference power supply voltage output circuit being disposed between an analog reference power supply pad and the data driver, the analog reference power supply pad being connected to a stabilization capacitor that stabilizes the analog reference power supply voltage.

5. The integrated circuit device as defined in claim 4, the power supply circuit including:

a ladder resistor circuit that divides a reference power supply voltage using resistors; and a select circuit that selects a divided voltage among a plurality of divided voltages divided by the ladder resistor circuit, and outputs the divided voltage to the analog reference power supply voltage output circuit, the analog reference power supply voltage output circuit being disposed between the ladder resistor circuit and the analog reference power supply pad.

6. The integrated circuit device as defined in claim 4, the power supply circuit including:

a Kth (K is a natural number) voltage-boost circuit disposed between a Kth voltage-boost pad connected to a Kth voltage-boost capacitor and the Mth memory block; and a (K+1)th voltage-boost circuit disposed between a (K+1) th voltage-boost pad connected to a (K+1)th voltage-boost capacitor and the (M+1)th memory block, the analog reference power supply pad being disposed between the Kth voltage-boost pad and the (K+1)th voltage-boost pad.

7. The integrated circuit device as defined in claim 6, further comprising:

a logic circuit that controls the power supply circuit and the data driver, a logic circuit pad being disposed in the first direction with respect to the Kth voltage-boost pad, the analog reference power supply pad, and the (K+1)th voltage-boost pad.

8. The integrated circuit device as defined in claim 1, the data driver including a grayscale generation amplifier that is configured by a flip-around sample-hold circuit.

9. The integrated circuit device as defined in claim 8, the grayscale generation amplifier including:

the operational amplifier;

a first sampling capacitor that is provided between the first input terminal of the operational amplifier and a first input node of the grayscale generation amplifier and stores a charge corresponding to an input voltage at the first input node in a sample period; and a second sampling capacitor that is provided between the first input terminal of the operational amplifier and a second input node of the grayscale generation amplifier and stores a charge corresponding to an input voltage at the second input node in the sample period, the grayscale generation amplifier outputting an output voltage in a hold period, the output voltage corresponding to charges stored in the first sampling capacitor and the second sampling capacitor in the sample period.

10. The integrated circuit device as defined in claim 8, the grayscale generation amplifier including:

the operational amplifier, the analog reference power supply voltage being supplied to the second input terminal of the operational amplifier;

a first sampling switch element and a first sampling capacitor, the first sampling switch element and the first sampling capacitor being provided between a first input node of the grayscale generation amplifier and the first input terminal of the operational amplifier;

a second sampling switch element and a second sampling capacitor, the second sampling switch element and the second sampling capacitor being provided between a second input node of the grayscale generation amplifier and the first input terminal of the operational amplifier;

a feedback switch element provided between an output terminal and the first input terminal of the operational amplifier;

a first flip-around switch element provided between a first connection node and the output terminal of the operational amplifier, the first connection node being situated between the first sampling switch element and the first sampling capacitor; and a second flip-around switch element provided between a second connection node and the output terminal of the operational amplifier, the second connection node being situated between the second sampling switch element and the second sampling capacitor.

11. The integrated circuit device as defined in claim 10, the first sampling switch element, the second sampling switch element, and the feedback switch element being turned ON and the first flip-around switch element and the second flip-around switch element being turned OFF in the sample period; and the first sampling switch element, the second sampling switch element, and the feedback switch element being turned OFF and the first flip-around switch element and the second flip-around switch element being turned ON in a hold period.

12. The integrated circuit device as defined in claim 11, the first sampling switch element and the second sampling switch element being turned OFF after the feedback switch element has been turned OFF.

13. The integrated circuit device as defined in claim 10, the analog reference power supply voltage supplied to the second input terminal of the operational amplifier being set at a voltage between a high-potential-side power supply voltage and a low-potential-side power supply voltage of switch control signals supplied to the first sampling switch element, the second sampling switch element, the feedback switch element, the first second flip-around switch element, and the second flip-around switch element.

14. An electro-optical device comprising the integrated circuit device as defined in claim 1.

15. An electronic instrument comprising the electro-optical device as defined in claim 14.

* * * * *